US012448876B2

(12) United States Patent
Messer et al.

(10) Patent No.: US 12,448,876 B2
(45) Date of Patent: Oct. 21, 2025

(54) SYSTEM AND METHOD FOR DETERMINING PLUNGER VELOCITY USING A DOWNHOLE CARD FOR DIAGNOSTICS AND CONTROL OF A ROD-PUMPED WELL

(71) Applicant: WellWorx Energy Solutions LLC, Midland, TX (US)

(72) Inventors: Russell J. Messer, Tomball, TX (US); John M. Raglin, Midland, TX (US)

( * ) Notice: Subject to any disclaimer, the term of this patent is extended or adjusted under 35 U.S.C. 154(b) by 0 days.

(21) Appl. No.: 18/766,510

(22) Filed: Jul. 8, 2024

(65) Prior Publication Data

US 2025/0012176 A1 Jan. 9, 2025

Related U.S. Application Data

(60) Provisional application No. 63/525,527, filed on Jul. 7, 2023.

(51) Int. Cl.

| | |
|---|---|
| ***E21B 43/12*** | (2006.01) |
| ***E21B 47/117*** | (2012.01) |
| ***F04B 51/00*** | (2006.01) |

(52) U.S. Cl.

CPC ..... *E21B 43/127* (2013.01); *E21B 47/117* (2020.05); *F04B 51/00* (2013.01)

(58) Field of Classification Search

CPC ..... E21B 43/127; E21B 47/117; F04B 51/00
USPC ..... 166/250.08
See application file for complete search history.

(56) References Cited

U.S. PATENT DOCUMENTS

| | | | | |
|---|---|---|---|---|
| 3,343,409 | A | 9/1967 | Gibbs | |
| 5,146,991 | A * | 9/1992 | Rogers, Jr. | E21B 43/121 137/624.2 |
| 5,823,262 | A * | 10/1998 | Dutton | E21B 47/009 166/250.15 |
| 9,587,479 | B2 * | 3/2017 | Scantlebury | E21B 43/121 |
| 2003/0065447 | A1 * | 4/2003 | Bramlett | E21B 47/009 702/6 |
| 2006/0149476 | A1 * | 7/2006 | Gibbs | E21B 47/009 702/6 |
| 2016/0102542 | A1 * | 4/2016 | DaCunha | F04B 49/065 702/6 |
| 2017/0152737 | A1 * | 6/2017 | Pons | E21B 43/127 |
| 2020/0018151 | A1 * | 1/2020 | Pons | E21B 43/127 |
| 2020/0263530 | A1 | 8/2020 | Perez | |
| 2023/0407733 | A1 * | 12/2023 | Green | E21B 43/121 |

OTHER PUBLICATIONS

International Search Report and Written Opinion dated Oct. 9, 2024, for International Application No. PCT/US2024/037065, 19 pages.

* cited by examiner

*Primary Examiner* — Taras P Bemko
(74) *Attorney, Agent, or Firm* — Bell Nunnally & Martin LLP

(57) ABSTRACT

A system and method for determining plunger velocity in a rod pumped well using position data from a downhole card to determine plunger velocity during a pump stroke and plotting normalized plunger velocity over a downhole card.

16 Claims, 33 Drawing Sheets

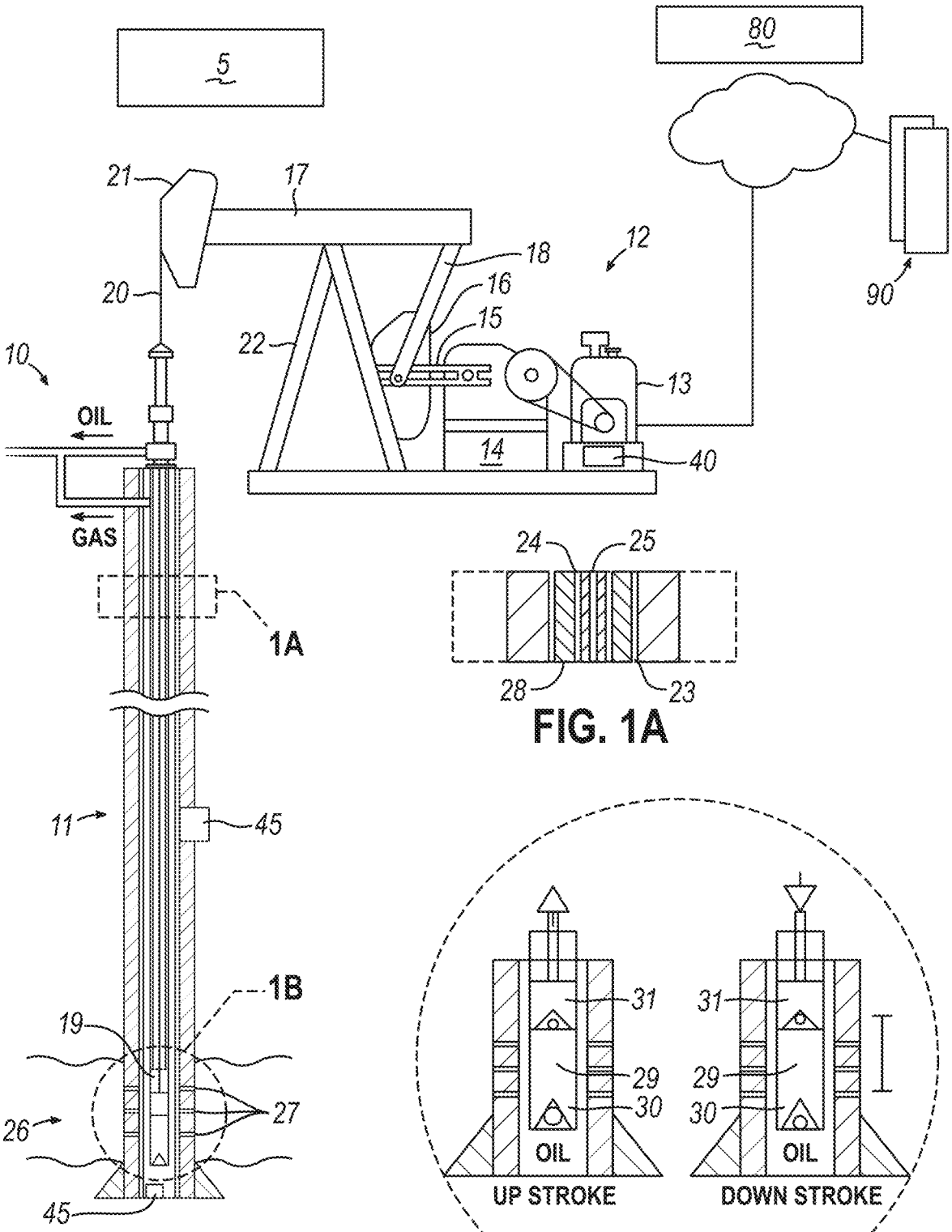
FIG. 1
FIG. 1A
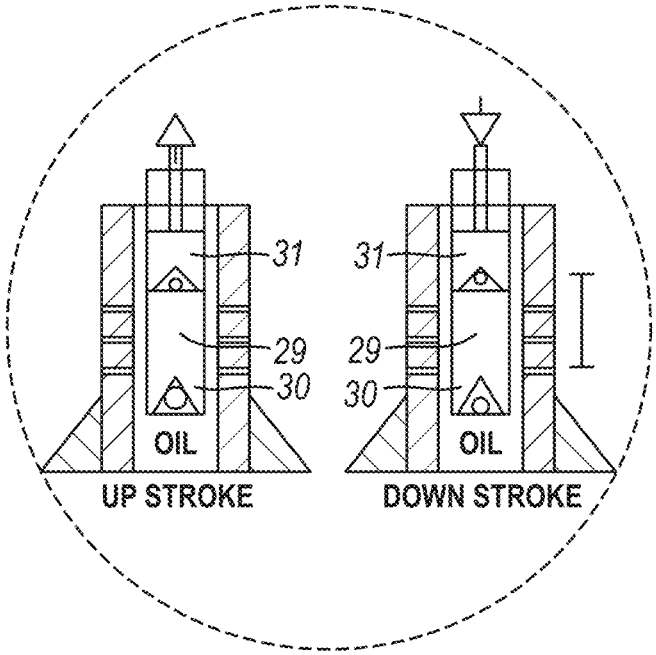
FIG. 1B

| Surface Position 1 | Surface Load 1 | Downhole Position 1 | Downhole Load 1 | Velocity | SPM 1 |
|---|---|---|---|---|---|
| 0 | 12.99586813 | 4.537211908 | -2.245122315 | -0.942646587 | 9 |
| 0.007721731 | 12.99695955 | 3.594565321 | -2.243496973 | -0.825037746 | |
| 0.018529032 | 12.99975804 | 2.769527575 | -2.237404373 | -0.705053251 | |
| 0.027143983 | 13.00081292 | 2.064474324 | -2.207020231 | -0.585903699 | |
| 0.036097407 | 13.00296897 | 1.478570625 | -2.134684156 | -0.471105285 | |
| 0.049070062 | 13.00686838 | 1.00746534 | -2.007626723 | -0.364068829 | |
| 0.059518636 | 13.0087801 | 0.64339651 | -1.820049839 | -0.267724564 | |
| 0.07012512 | 13.01131315 | 0.375671947 | -1.57420995 | -0.184223686 | |
| 0.085436721 | 13.01387589 | 0.191448261 | -1.280305786 | -0.11474315 | |
| 0.097566769 | 13.01570361 | 0.076705111 | -0.955161049 | -0.059404243 | |
| 0.109849868 | 13.01803776 | 0.017300867 | -0.619889312 | -0.017300867 | |
| 0.127400817 | 13.01991801 | 0 | -0.296895103 | 0.013377937 | |
| 0.140946616 | 13.02212492 | 0.013377937 | -0.006678755 | 0.035153725 | |
| 0.154649996 | 13.02304916 | 0.048531662 | 0.235052061 | 0.051017713 | |
| 0.174141396 | 13.02575946 | 0.099549375 | 0.419508271 | 0.064167164 | |
| 0.18921814 | 13.02680715 | 0.163716539 | 0.545850446 | 0.077739699 | |
| 0.215138011 | 13.03168623 | 0.241456238 | 0.620971907 | 0.09456192 | |
| 0.249269974 | 13.03666166 | 0.336018159 | 0.658085844 | 0.116925146 | |
| 0.276566249 | 13.04020807 | 0.452943304 | 0.674364378 | 0.146398795 | |
| 0.304733481 | 13.04494537 | 0.5993421 | 0.688031062 | 0.18369123 | |
| 0.344949237 | 13.05065664 | 0.78303333 | 0.715393388 | 0.228568115 | |
| 0.376632552 | 13.05438887 | 1.011601444 | 0.768304103 | 0.279838518 | |
| 0.40906615 | 13.05868954 | 1.291439962 | 0.852459672 | 0.335417888 | |
| 0.45568021 | 13.06478671 | 1.62685785 | 0.966795387 | 0.392473586 | |
| 0.492022996 | 13.0701213 | 2.019331436 | 1.104045603 | 0.447652399 | |
| 0.529500371 | 13.07578094 | 2.466983835 | 1.252337886 | 0.497380515 | |
| 0.582425787 | 13.0837101 | 2.96436435 | 1.397516001 | 0.53821593 | |
| 0.623529801 | 13.08980497 | 3.502580279 | 1.525768648 | 0.567222796 | |
| 0.665679696 | 13.09591021 | 4.069803075 | 1.626098451 | 0.58232891 | |
| 0.72528919 | 13.10541684 | 4.652131985 | 1.69220522 | 0.582623406 | |
| 0.770495497 | 13.11129202 | 5.234755391 | 1.723470795 | 0.568553353 | |
| 0.817376417 | 13.1183892 | 5.803308743 | 1.724898749 | 0.541985958 | |
| 0.883216915 | 13.12857957 | 6.345294702 | 1.706050687 | 0.50611717 | |
| 0.933855263 | 13.13672334 | 6.851411872 | 1.679198005 | 0.465225932 | |
| 0.985484362 | 13.14621224 | 7.316637803 | 1.657042566 | 0.424293826 | |
| 1.057971988 | 13.15797065 | 7.740931629 | 1.650428361 | 0.388529084 | |
| 1.11242539 | 13.1671942 | 8.129460714 | 1.666457835 | 0.362848932 | |
| 1.169633888 | 13.17722829 | 8.492309646 | 1.707343849 | 0.351382258 | |
| 1.247603409 | 13.19163914 | 8.843691904 | 1.770187492 | 0.357054004 | |
| 1.306908801 | 13.20300241 | 9.200745908 | 1.847699427 | 0.381303247 | |
| 1.368724424 | 13.21413356 | 9.582049155 | 1.929709968 | 0.42396975 | |
| 1.453155151 | 13.23002137 | 10.0060189 | 2.005171943 | 0.483361341 | |
| 1.517830855 | 13.24207439 | 10.48938025 | 2.064275739 | 0.556490206 | |
| 1.585131159 | 13.25467699 | 11.04587045 | 2.100282388 | 0.639443768 | |
| 1.67604318 | 13.27240003 | 11.68531422 | 2.110739444 | 0.727838789 | |
| 1.745384953 | 13.28481081 | 12.41315301 | 2.097864044 | 0.81729825 | |

FIG. 3

SYSTEM AND METHOD FOR DETERMINING PLUNGER VELOCITY USING A DOWNHOLE CARD FOR DIAGNOSTICS AND CONTROL OF A ROD-PUMPED WELL

PRIORITY CLAIM

This application claims the benefit of U.S. Provisional Patent Application No. 63/525,527, entitled "System and Method for Determining Plunger Velocity Using a Downhole Card," filed Jul. 7, 2023, the contents are which are hereby incorporated by reference.

BACKGROUND OF THE INVENTION

When a well's own energy is not enough to bring the produced fluids to the surface, an artificial lift system is needed to help lift the fluid from the wellbore. One of these methods is sucker rod pumps. In sucker rod pumps, the circular motion of crank at the surface is translated downhole to the pump using a polished rod and rod string.

In deep wells the long sucker rod has considerable stretch, distributed mass, etc., and motion at the pump end may be radically different from that imparted at the upper end. One method of determining pump performance involves plotting a curve of rod load versus displacement. The shape of the curve or "card" reflects the conditions which prevail downhole in the well. U.S. Pat. No. 3,343,409 describes a method for determining the downhole performance of a rod pumped well by measuring surface data, (the surface card) and computing a load versus displacement curve (a "pump card" for the sucker rod string at any selected depth in the well). These downhole cards or plots can be used to alter the operating conditions of the well, such as by slowing down the rod cycle to increase the time for the pump to fill during a rod cycle. Essential quantities can be extracted from the downhole data to diagnose, interpret, and modify control of the well and fluid extraction.

SUMMARY

One embodiment under the present disclosure comprises a method for determining plunger velocity in a rod pumped well. The method comprises using position data from a downhole card to determine plunger velocity during a pump stroke; and plotting normalized plunger velocity over a downhole card.

Another embodiment under the present disclosure comprises an oil well. The oil well comprises a well assembly and pump assembly. The well assembly comprises a casing extending toward an oil bearing region; a tubing extending at least partially through the casing; a sucker rod extending at least partially through the tubing; and a plunger coupled to the sucker rod and configured to create an upstroke and downstroke in the oil bearing region to extract oil from the oil bearing region into the casing. The pump assembly is coupled to the well assembly and comprises: a motor configured to supply power to the pump assembly and the well assembly; and a gear box configured to direct power from the motor to the well assembly and the sucker rod. The oil well further comprises one or more sensors configured to detect one or more properties within the oil well; and a controller communicatively coupled to the one or more sensors and configured to control the pump assembly and the well assembly. The controller comprises one or more processors; and a non-transitory, computer-readable storage medium in operable communication with at least one processor of the one or more processors, wherein the computer-readable storage medium contains one or more programming instructions that, when executed, cause the processor to: create a downhole card based at least in part on the one or more properties from the one or more sensors; use position data from the downhole card to determine plunger velocity during a pump stroke; and plot normalized plunger velocity over the downhole card.

A further embodiment under the present disclosure comprises a method for determining plunger velocity in a rod pumped well. The method comprises using position data from a downhole card to determine plunger velocity during a pump stroke; plotting normalized plunger velocity over a downhole card; and controlling a pumping unit of the rod pumped well using the plunger velocity and downhole card data.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

BRIEF DESCRIPTION OF THE DRAWINGS

While the specification concludes with claims which particularly point out and distinctly claim this technology, it is believed this technology will be better understood from the following description of certain examples taken in conjunction with the accompanying drawings, in which like reference numerals identify the same elements and in which:

FIGS. 1-1B depict a schematic view of an oil well;

FIG. 3 depicts a chart having surface date, position, and load used to calculate downhole data;

DETAILED DESCRIPTION

Figure 2A:
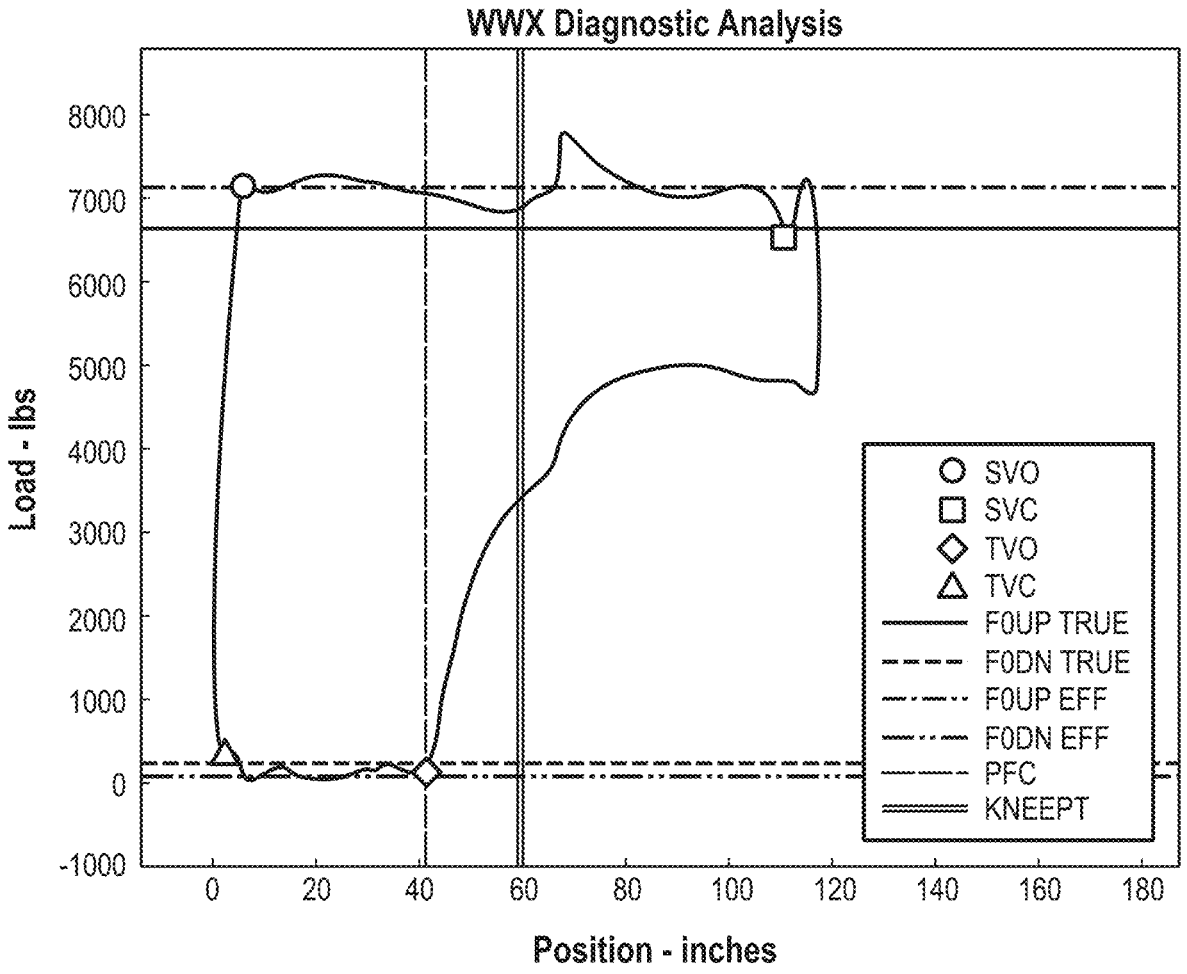
FIGS. 2A-2E depict examples of various downhole cards.
Figure 2B:
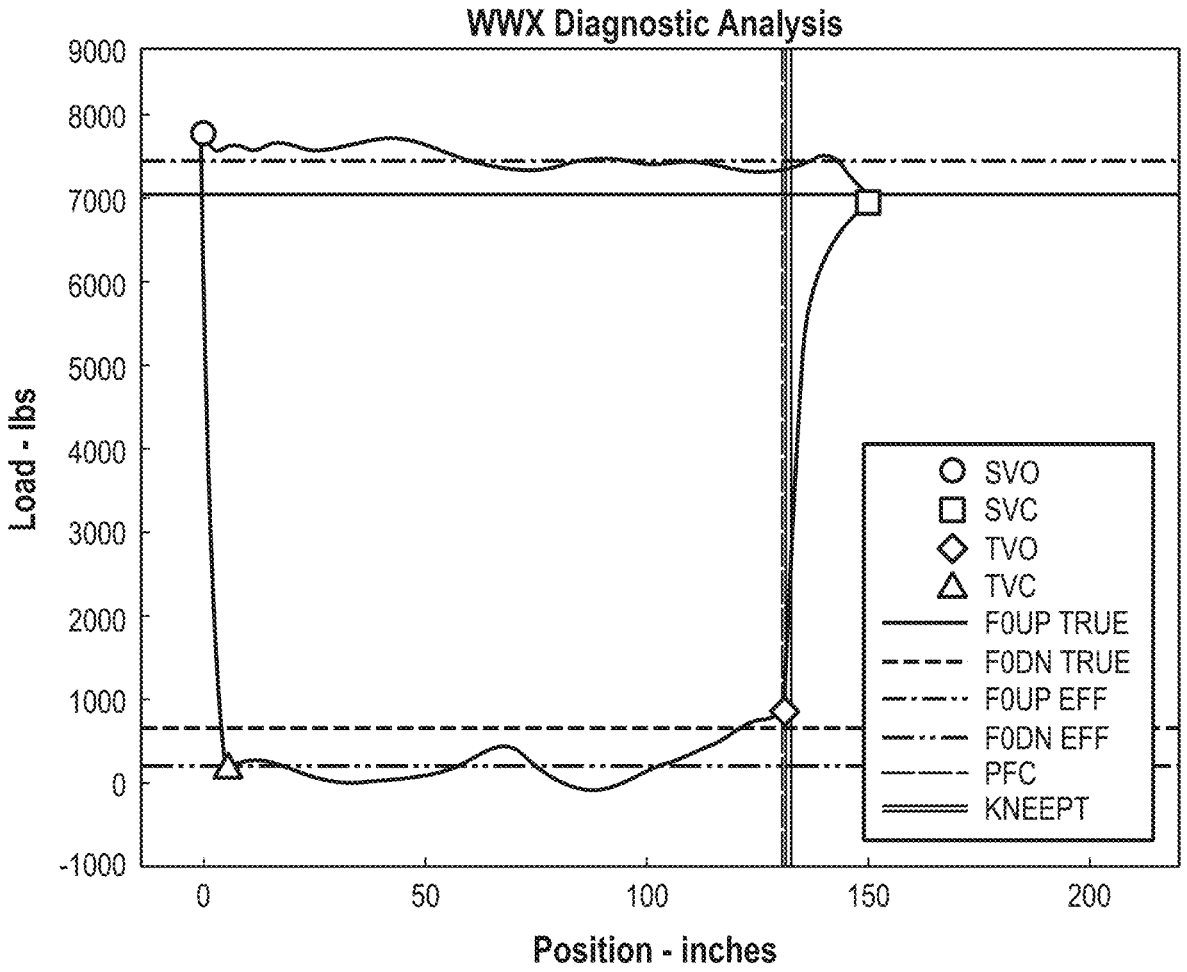
Figure 2C:
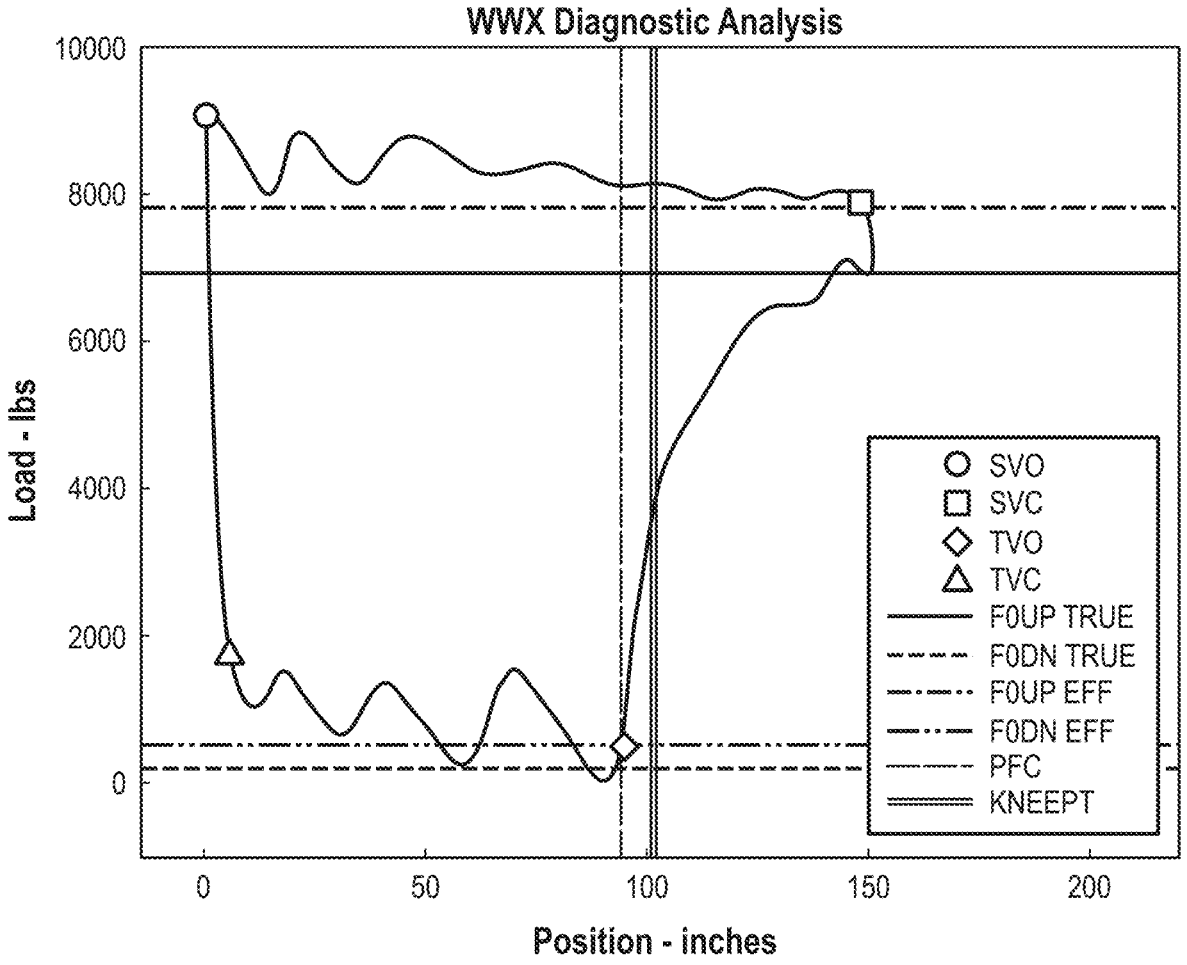
Figure 2D:
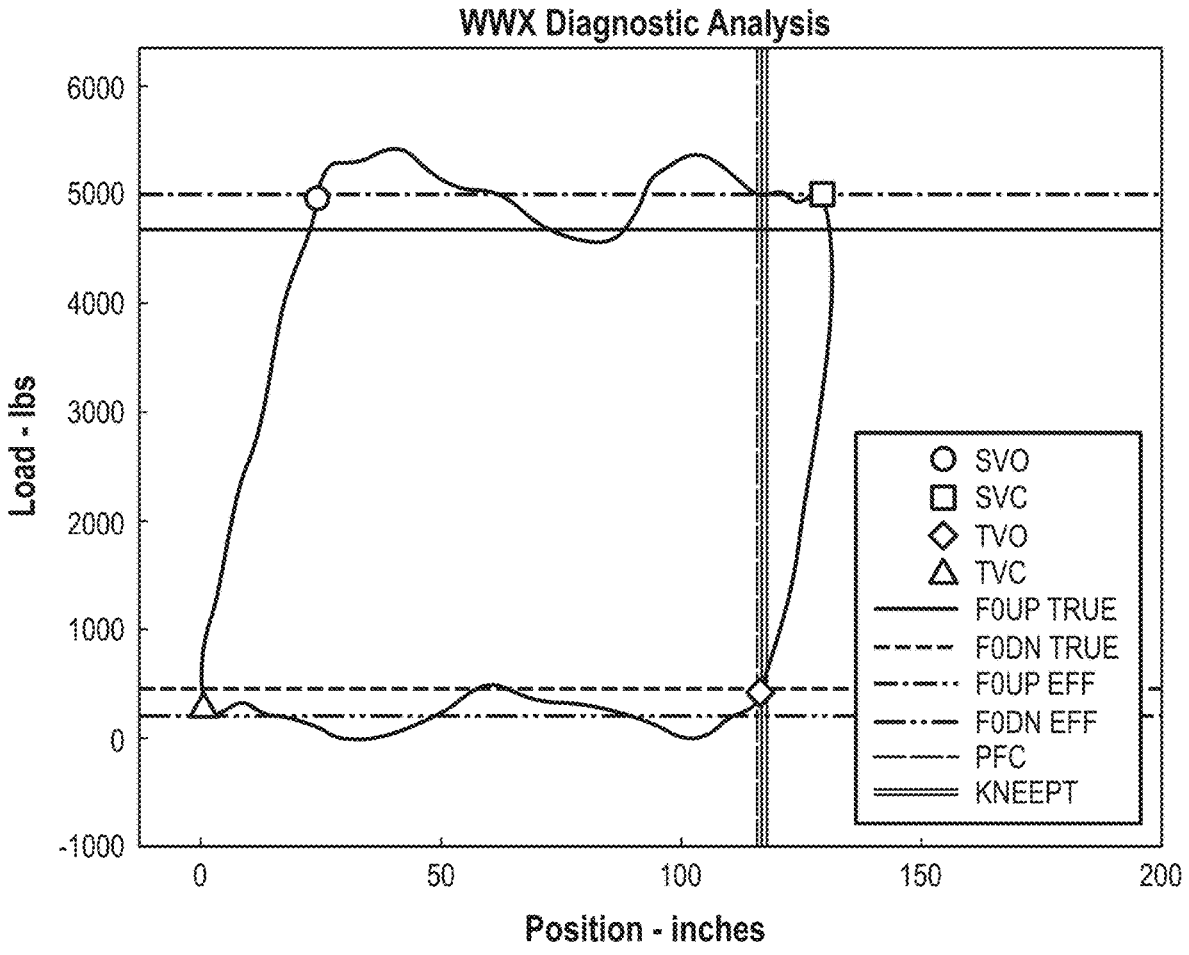
Figure 2E:
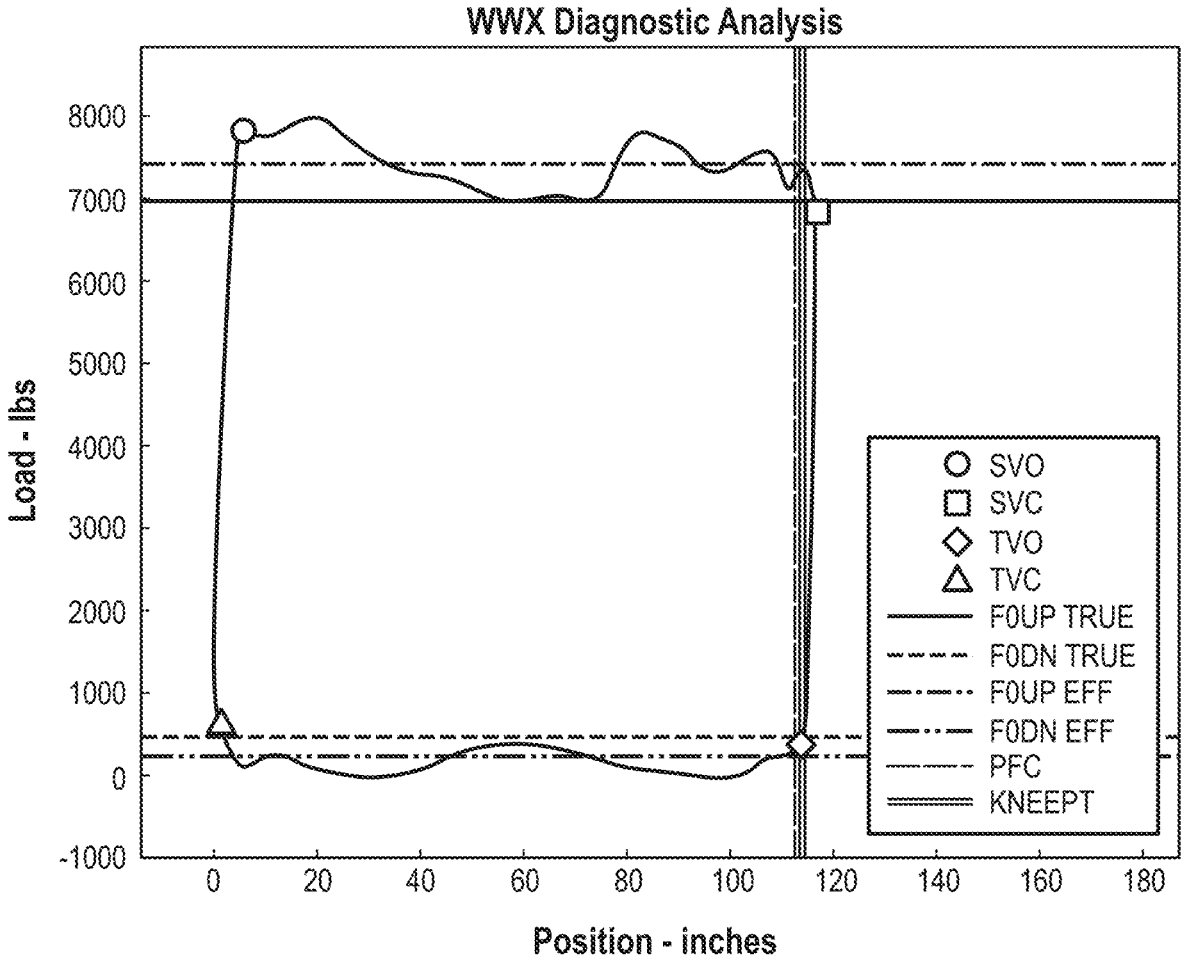

There currently exist certain challenges related to wells and downhole cards. One piece of information that is missing from existing downhole cards is the plunger velocity during a pumping stroke. The plunger velocity can vary during a pump stroke because of compression and stretching of the well string during a stroke, or it may be physically altered using a variable frequency drive that can change the motor speed of the pump during the stroke. It would be helpful to be able to see and use the pump velocity in conjunction with the downhole card to diagnose and control the operation of the well.

Certain embodiments can provide solutions to these or other challenges. Certain embodiments described herein provide an accurate and robust way to determine plunger velocity, plot plunger velocity over a traditional downhole card and control well operation using plunger velocity data that is gathered every stroke in real time via the POC (pump off controller), edge device, SCADA (supervisory control and data acquisition) System, Integrated VFD (variable frequency drive), or Cloud based control system.

There are numerous advantages to various embodiments under the present disclosure. Certain embodiments described herein can provide an accurate and robust way to determine plunger velocity, plot plunger velocity over a traditional downhole card, and control well operation using plunger velocity data that is gathered every stroke in real time via the pump off controller/edge device/SCADA System/Integrated VFD or Cloud based control system. Furthermore, certain embodiments can use plunger velocity as an input for control, something that has been unavailable in the prior art.

Referring now to FIGS. 1, 1A and 1B, a diagram of a oil well system 5 under the present disclosure is shown. Oil well system 5 can comprise a well assembly 10 and pump assembly 12. Well 10 can comprise e.g., a sucker rod pump used in oil wells, but other types of wells are possible. Well 10 includes well bore 11 and pump assembly 12. Pump assembly 12 is formed by a motor 13 that supplies power to a gear box 14. Gear box 14 is operable to reduce the angular velocity produced by motor 13 and to increase the torque relative to the input of motor 13. The input of motor 13 is used to turn crank 15 and lift counter weight 16. As crank 15 is connected to walking beam 17 via pitman arm 18, walking beam 17 pivots and submerges plunger 19 in well bore 11 using bridle 20 connected to walking beam 17 by horse head 21. Walking beam 17 is supported by Sampson post 22.

Well bore 11 includes casing 23 and tubing 24 extending inside casing 23. Sucker rod 25 extends through the interior of tubing 24 to plunger 19. At the bottom of well bore 11 in oil bearing region 26, casing 23 includes perforations 27 that allow hydrocarbons and other material to enter annulus 28 between casing 23 and tubing 24. Gas is permitted to separate from the liquid products and travel up the annulus where it is captured. Liquid well products collect around pump barrel 29, which contains standing valve 30. Plunger 19 includes traveling valve 31. During the down stroke of the plunger, traveling valve is opened and product in the pump barrel is forced into the interior of tubing 24. When the pump begins its upstroke, traveling valve 31 is closed and the material in the tubing is formed forced up the tubing by the motion of plunger 19.

Controller 40 can control the one or more functionalities or processes of well 10 and/or pump assembly 12. Controller 40 may be powered by motor 13 or another power supply. Controller 40 may be communicatively coupled (wireless or wired) with e.g., sensors 45 within well 10, which may measure properties such as e.g., depth, temperature, pressure, flow rates, plunger speed, wear on parts/components, or other parameters. Controller 40 can collect data on well 10 or pump assembly 12 and may be communicatively coupled with computing devices 90 via network 80. Network 80 can comprise Wi-fi, cellular, GPS (global positioning system), satellite, other networks, or combinations of the foregoing. Computing devices 90 can be remote or local to well 10, and can be used to control well 10 or pump assembly 12, collect and/or analyze data, and/or perform other tasks. Controller 40 and/or computing devices 90 can create downhole cards or utilize them in various processes as described further herein. In some embodiments, the functionalities of controller 40 may be implemented in computing device(s) 90 and be cloud-based. In some embodiments, controller 40 and/or computing device(s) 90 may be able to control multiple oil well systems 5, and may be able to implement methods further described herein across multiple oil well systems 5.

Creating a downhole card can take into account a variety of parameters. In certain embodiments three forces used with rod pumping include elasticity, viscous friction, and mechanical friction. Elasticity takes the form of stress waves traveling up and down the rod string at the speed of sound as the rod string material stretches and compresses with the cyclic motion of the pumping unit. Produced fluid being lifted to the surface creates a viscous force on the outer diameter of the rod string opposing its movement. Finally, either due to well deviation, paraffin or other external factors, the rod string and couplings cause mechanical friction with its contact with the inner diameter of the tubing.

In order to effectively control rod pumps, one should calculate not only the work done at the surface but also anticipate the energy losses to the system due to the above three conditions. Once the position of the plunger and the load on the plunger have been measured at the surface, the downhole data can be calculated and represented as a downhole card, examples of downhole cards under the present disclosure are shown in FIGS. 2A-2E. The plot of load versus position shows the operating conditions of the well during a full pump stroke. In broad terms, the corners of the top of the plot show the standing valve opening and closing points and the bottom shows the travelling valve opening and closing points. The shape of the plot, particularly the right edge can be indicative of how completely the pump is filling during a full stroke. The plot can be used to alter the operating conditions of the well, such as by slowing down the rod cycle to increase the time for the pump to fill during a rod cycle. Essential quantities can be extracted from the downhole data to diagnose, interpret, and modify control of the well and fluid extraction. Such quantities include but are not limited to pump fillage and fluid load, as well as valve opening and closing points.

One data point missing from a downhole card, however, is plunger velocity as it travels through a complete pump stroke. Fortunately, the downhole card data already collected can be used to calculate the plunger velocity through the pump stroke. FIG. 3 shows the surface data, position and load, used to calculate the downhole data, again position and load. The plunger velocity can be calculated using the downhole position data and the know time intervals between data points. The change in the downhole position over the sampling interval is used to determine plunger velocity, shown as Velocity in the table of FIG. 3.

Figure 4:
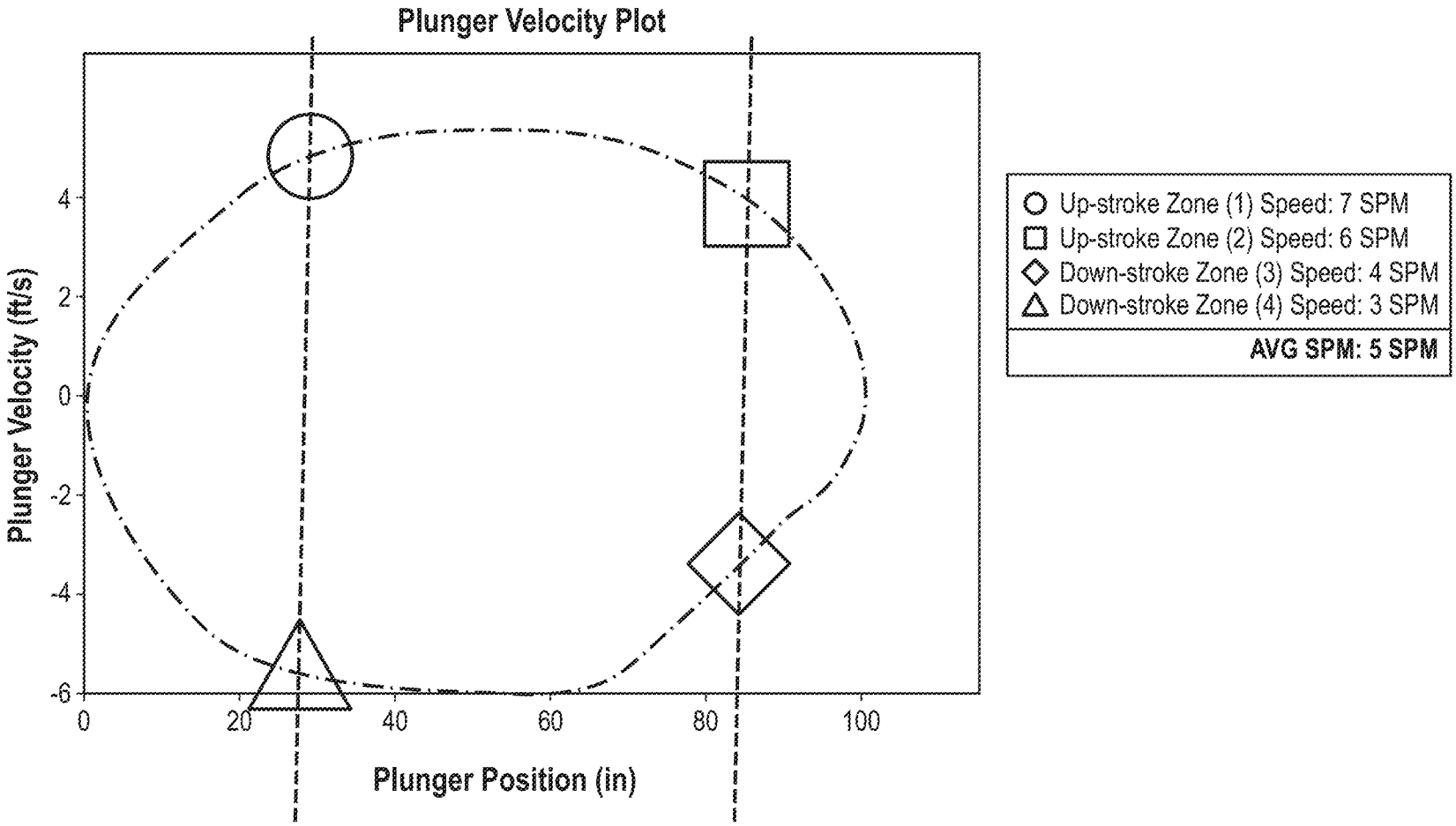
FIG. 4 depicts a chart having plunger velocity over a downhole card.

Once the plunger velocity has been determined, the data can be plotted with the plunger velocity (y-axis) plotted against plunger position (x-axis) to show the plunger velocity through an entire pump stroke. Such a plot is shown in FIG. 4. Using the downhole card data in this way allows the plunger velocity to be calculated on a stroke-by-stroke basis in real time.

Figure 5A:
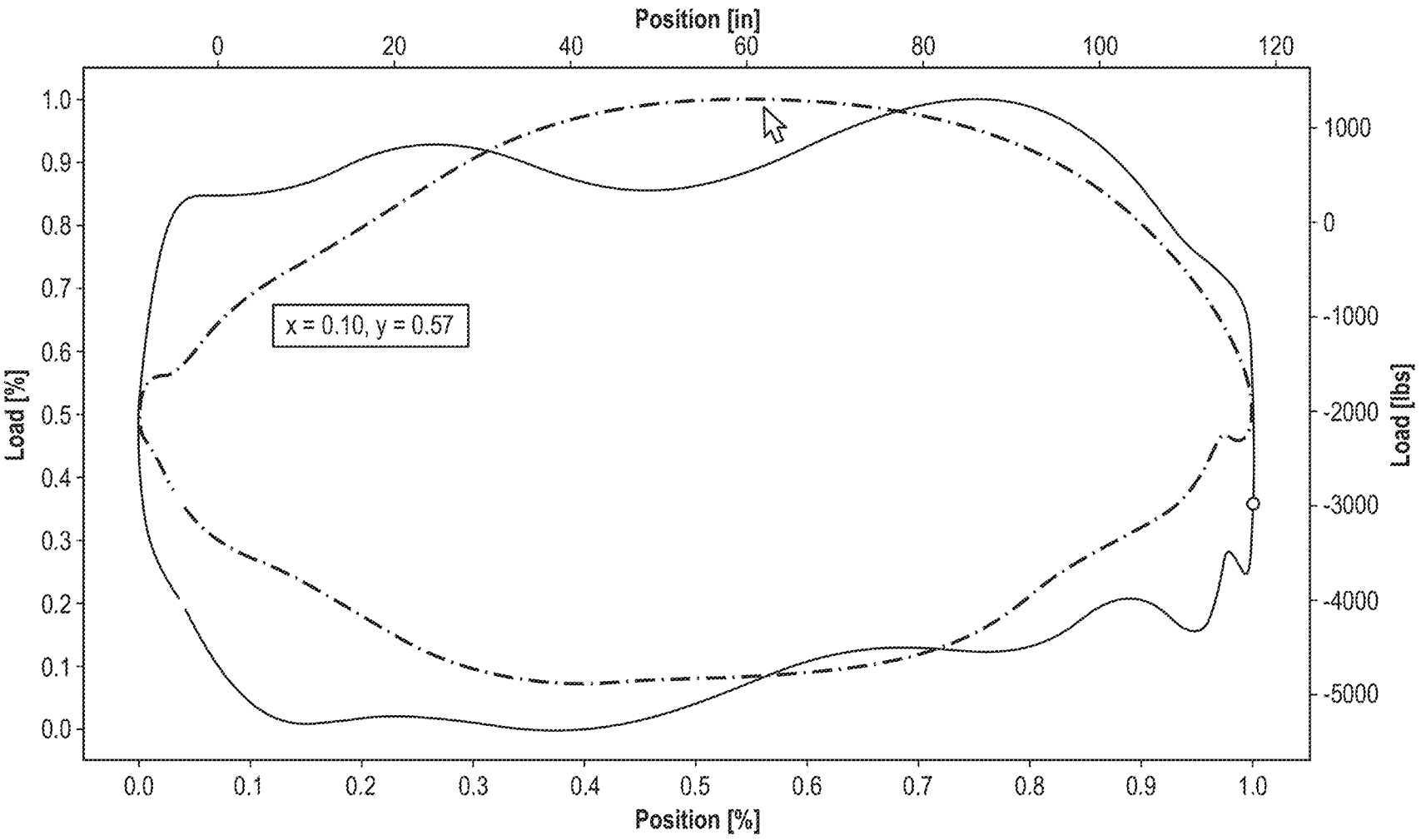
FIGS. 5A-5C depict various examples of plunger velocity and downhole card scenarios.
Figure 5B:
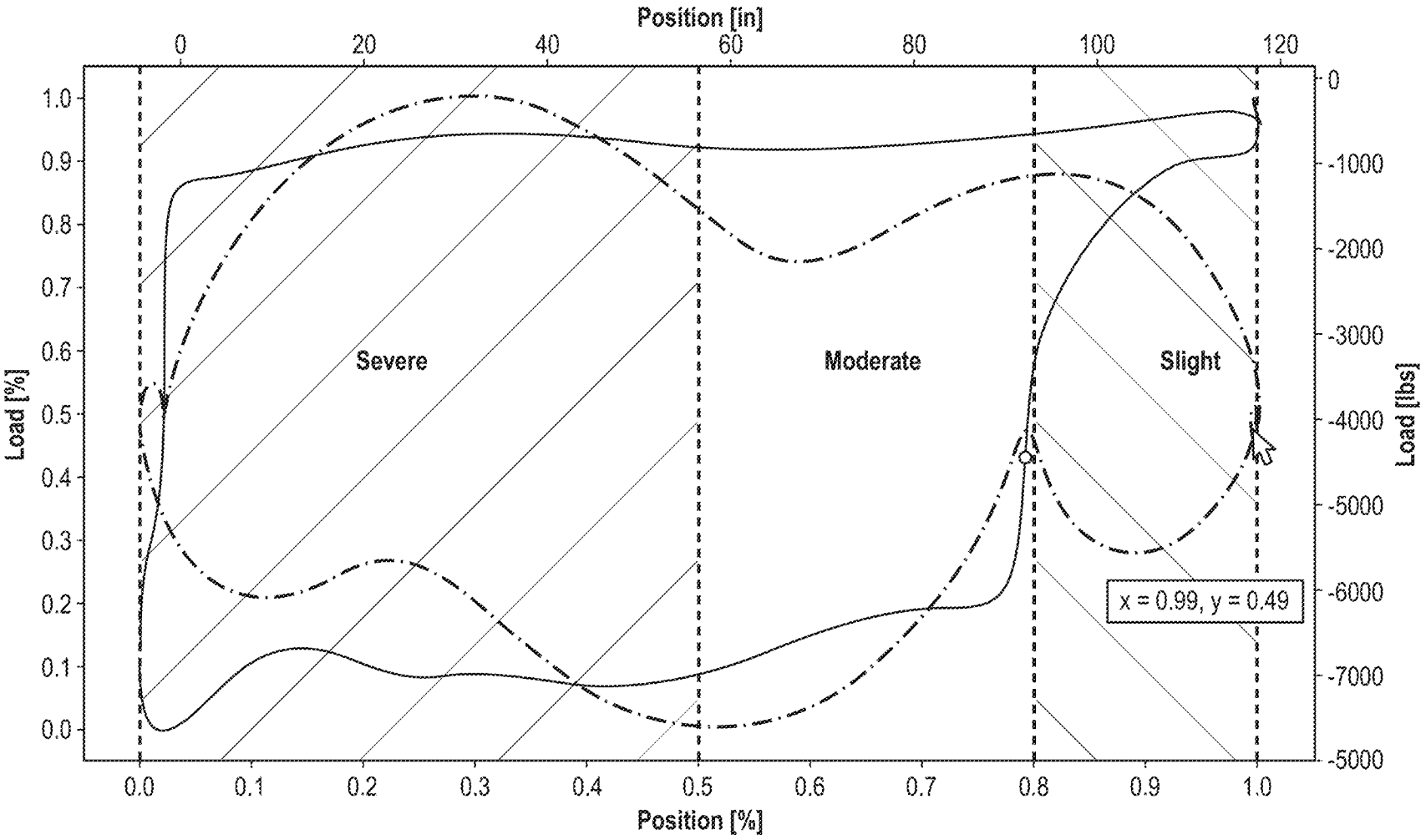
Figure 5C:
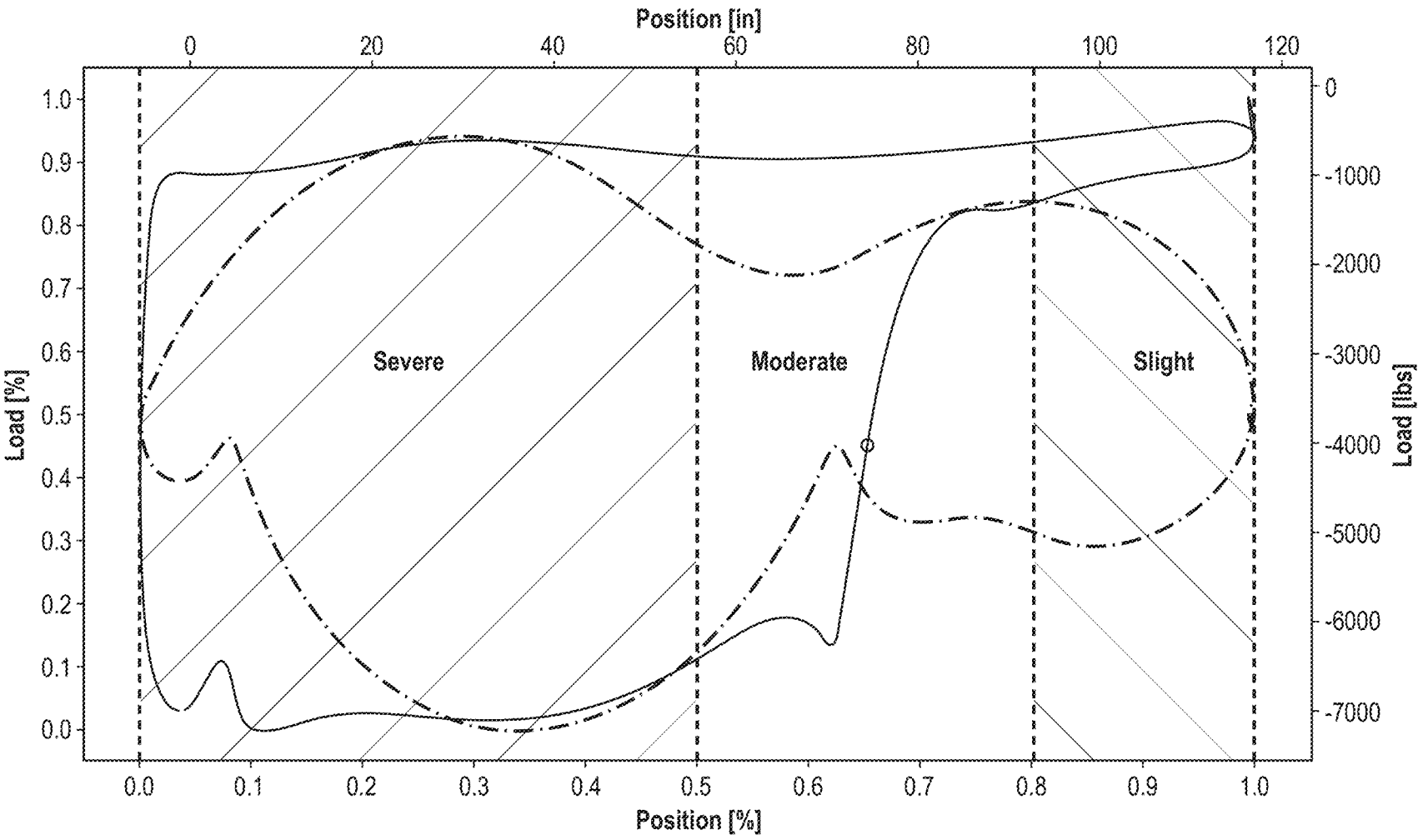

The plunger velocity plot of FIG. 4 can then be normalized and plotted over the downhole card to provide additional information for diagnosis and control of a well. FIGS. 5A-5C show certain embodiments under the present disclosure. The downhole card is shown as a solid line while the plunger velocity is shown as a dashed and dotted line. Once the normalized plunger velocity can be seen in relation to the downhole card (load vs. position), additional points of diagnosis of well conditions can be made. For example, and without limitation, the plunger velocity can be used to optimize Variable Frequency Drive Speed Zone Control where the pumping rod has its speed varied at different parts of the stroke by changing the drive frequency. This allows the pump to be slowed down during compression and expansion phases of the pump stroke to lessen wear on rod components, or to slow down during the filling portion of the stroke to minimize plunger pounding that can occur in a partially filled pump.

Additionally, other examples of pump diagnosis and control can include, e.g.:

- using real time plunger velocity to identify tagging conditions in real time and controlling on this functionality on rod pump wells;
- using real time plunger velocity to identify rod buckling conditions in real time and controlling based on this functionality on rod pump wells;
- using real time plunger velocity to identify the moment traveling valve opens to improve up-pump fillage pick algorithms on rod pump wells;
- using real time plunger velocity to help POC or integrated VFD differentiate between gas interference and pumped off conditions on rod pump wells;
- using real time plunger velocity to allow Integrated VFD system to automatically optimize SPM while avoiding rod buckling conditions on rod pump wells;
- using real time plunger velocity to allow Integrated VFD system to
- automatically optimize SPM while avoiding tagging conditions on rod pump wells. Controller 40 and/or computing device(s) 90 of FIG. 1 can be used to analyze this data and/or implement corrective actions by e.g., adjusting settings in pump assembly 12 or well 10.

Yet another application of the additional of plunger velocity to the downhole card involves utilizing the supplied plunger velocity plot from e.g., controller 40 that is calculated each stroke, and allowing a user to setup intra-stroke speed control to prevent rod buckling. FIGS. 5A-5C show calculated valve opening and closing points and control lines that can be used with a VFD drive. When a VFD is installed and "Plunger Velocity Based Speed Control" is enabled, user can slide the two green lines shown above right or left. This movement affects the exact intersection point on the live plunger velocity plot. The user can then define desired strokes per minute (SPM) at that point. This feature allows for intra-stroke speed control that has never before been accomplished. When configured properly, the controller and VFD will work together to: create a slow downstroke and a fast upstroke on conventional pumping units to aid in gas interference conditions. Slow downstrokes allow for more time to allow gas to break out of the stagnant fluid trapped in the BHA. Embodiments under the present disclosure making use of plunger velocity can improve these and other processes.

Additionally, any tagging that may take place on the down stroke would be less detrimental due to slower speed. This further allows for properly timed speed reductions around the transitions on long stroke pumping units. If rod buckling is shown on the plunger velocity plot in zone 3, the right vertical line could be shifted to the left of the buckling signature. This would allow user to slow the well down earlier at top of stroke and not speed back up until the compression event is passed.

While various examples of diagnosis and control scenarios have been described, these examples are not meant to be exhaustive and other use cases can be imagined or anticipated using the concepts described herein.

Figure 6A:
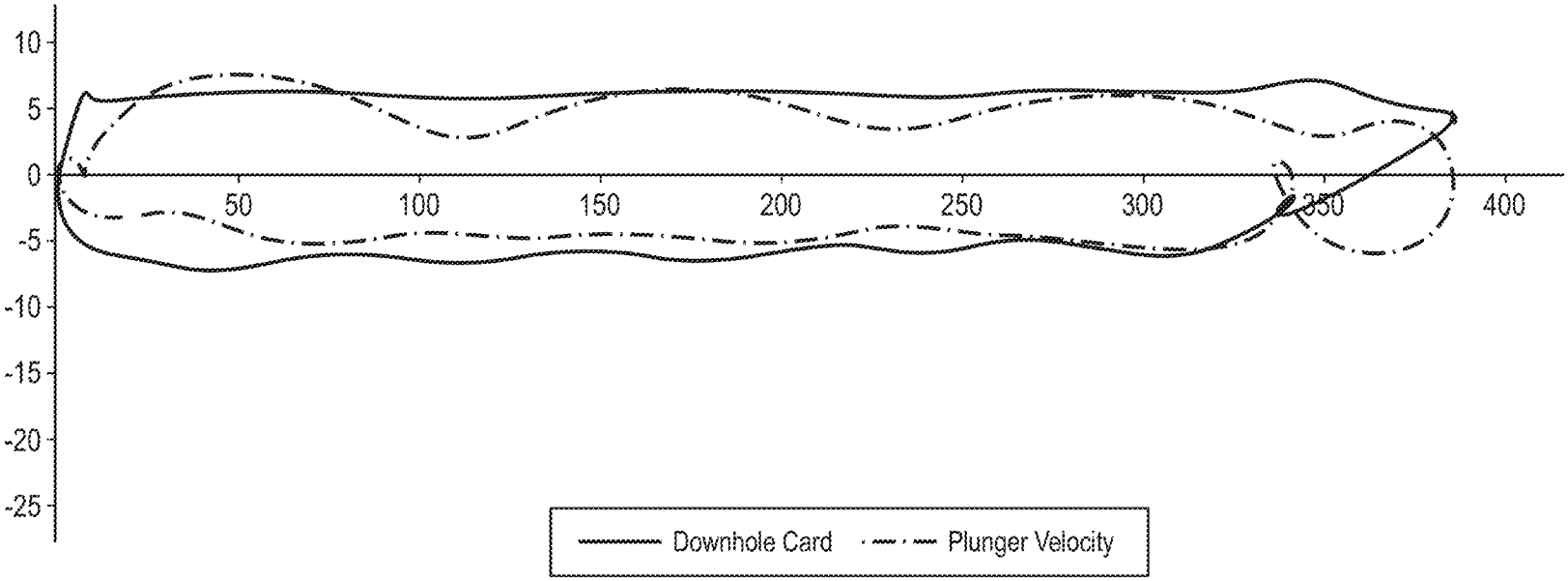
FIGS. 6A-6Q depict various examples of plunger velocity and downhole card scenarios.
Figure 6B:
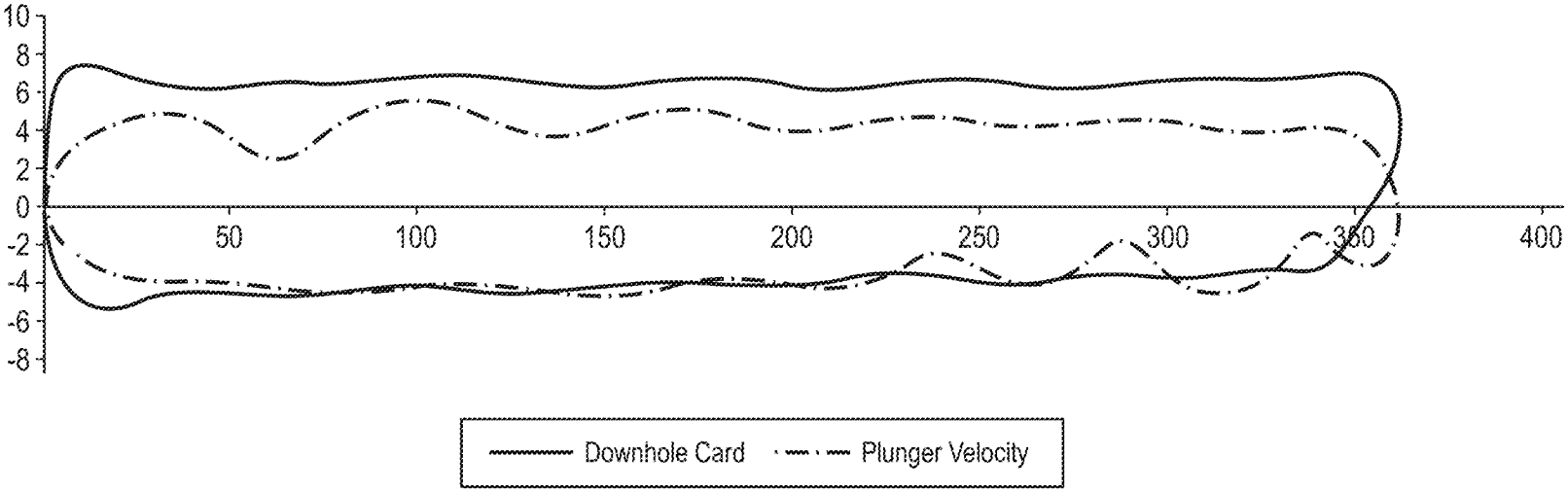
Figure 6C:
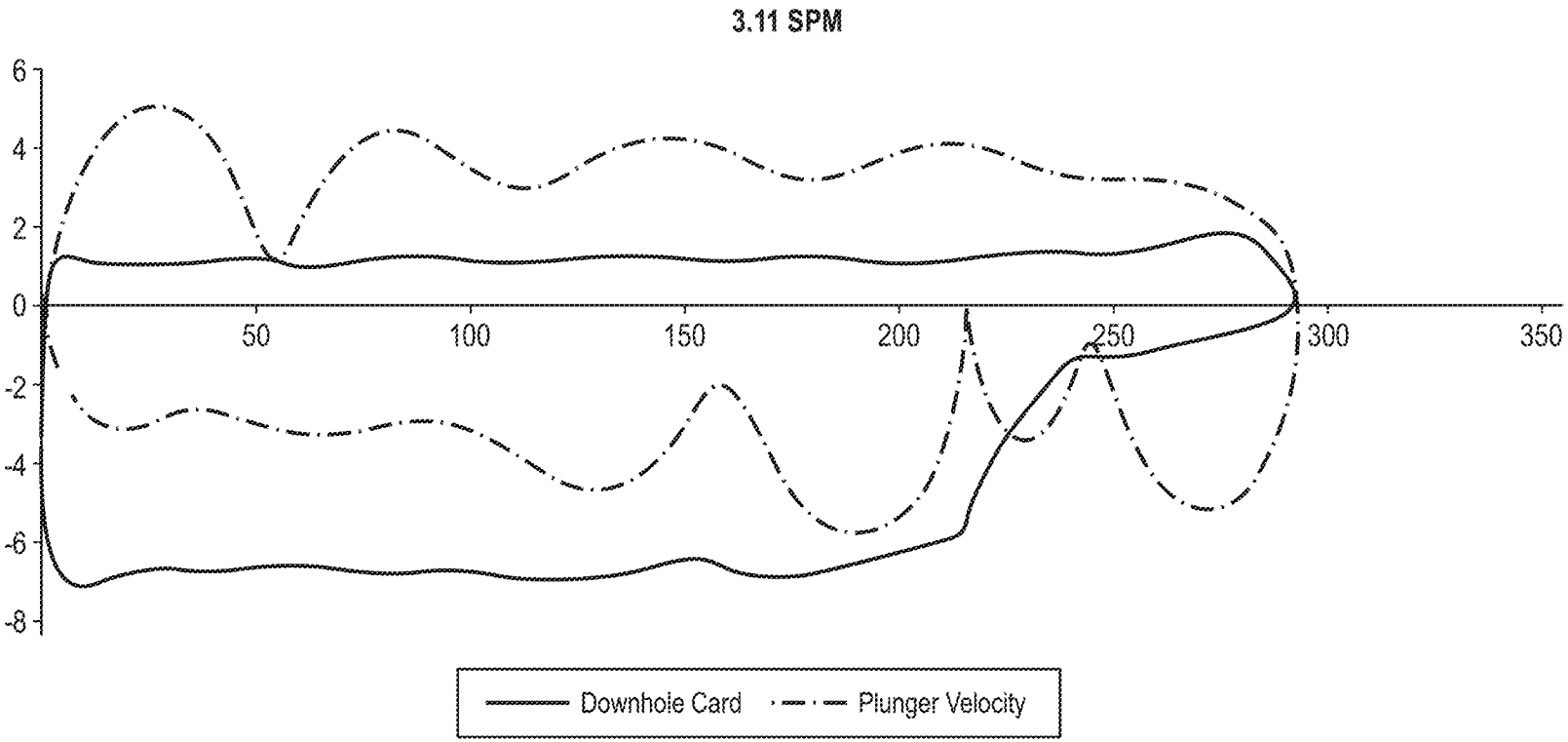
Figure 6D:
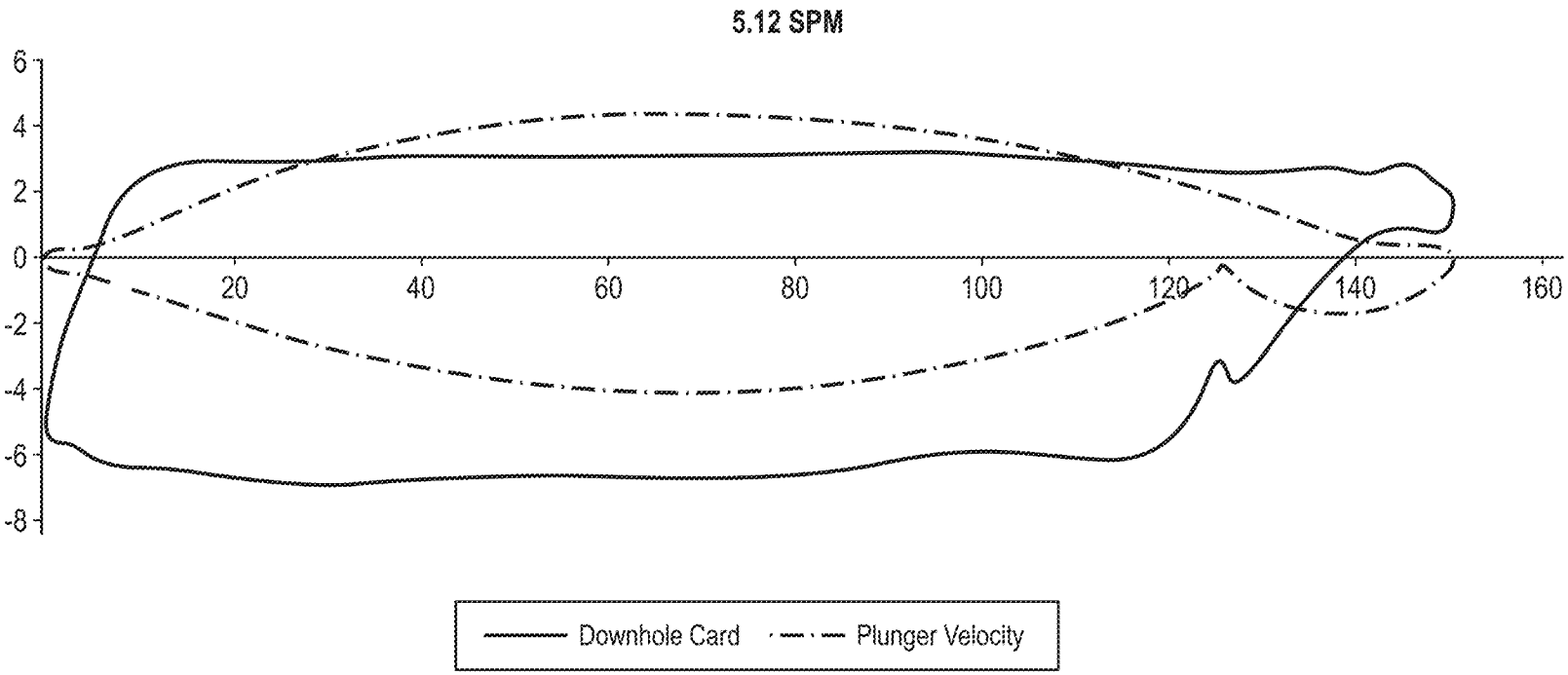
Figure 6E:
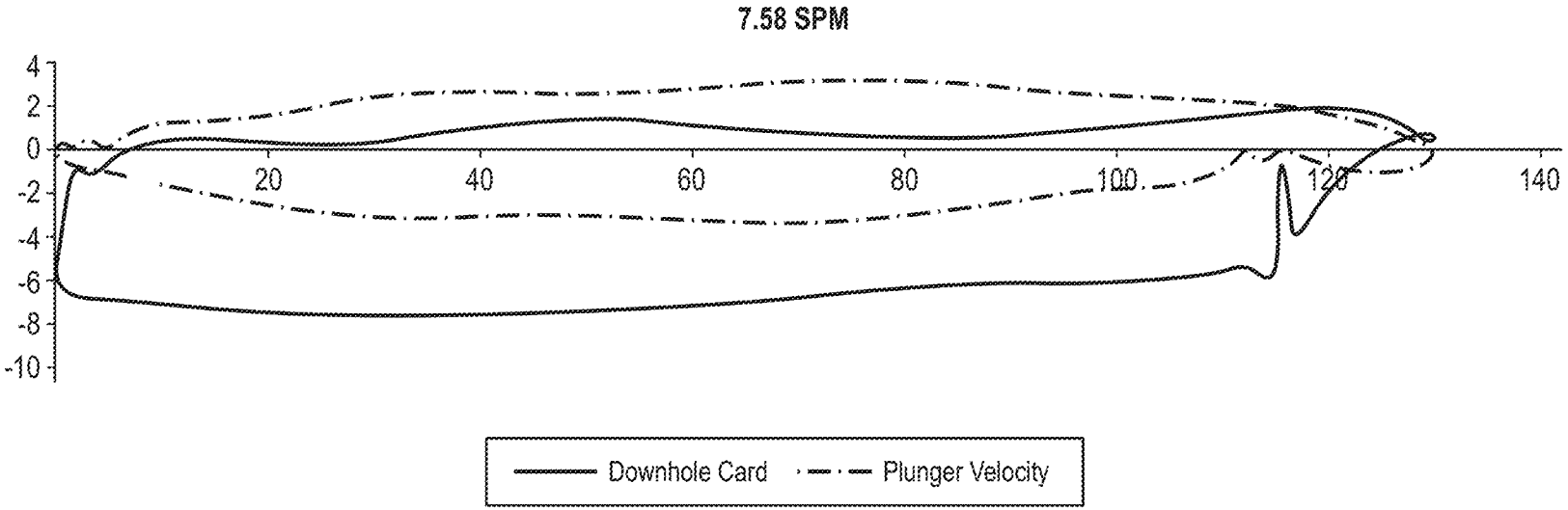
Figure 6F:
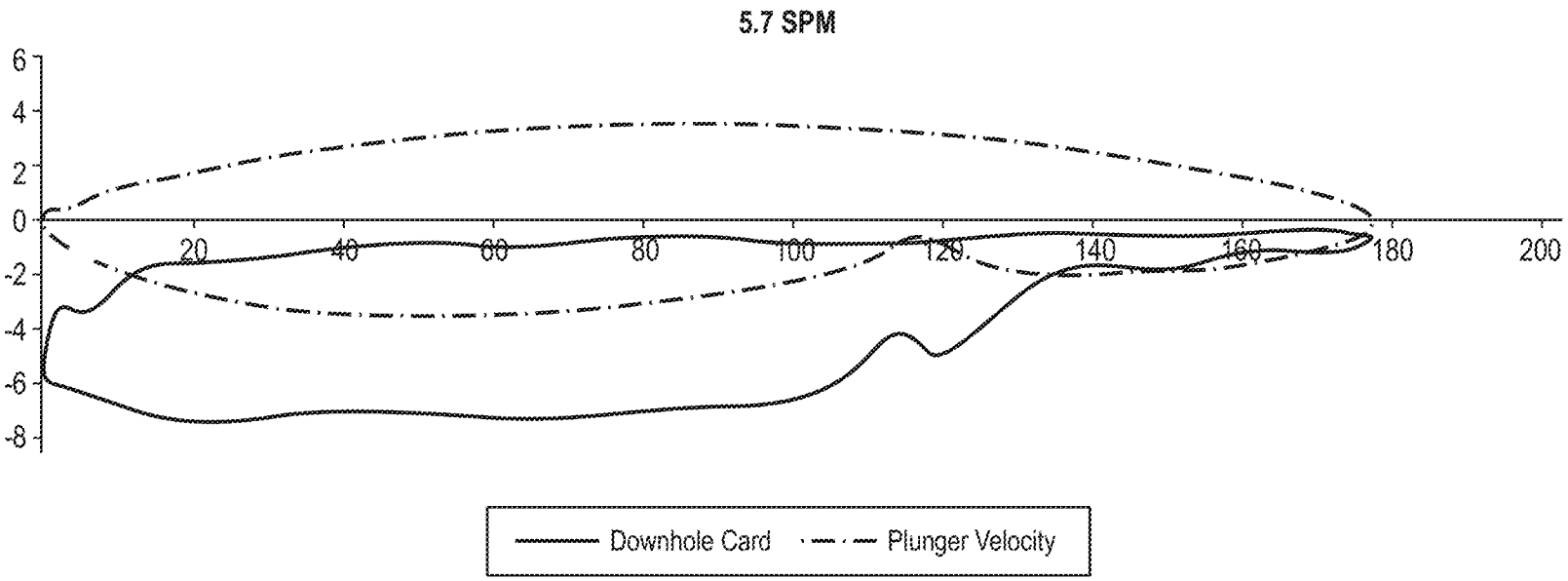
Figure 6G:
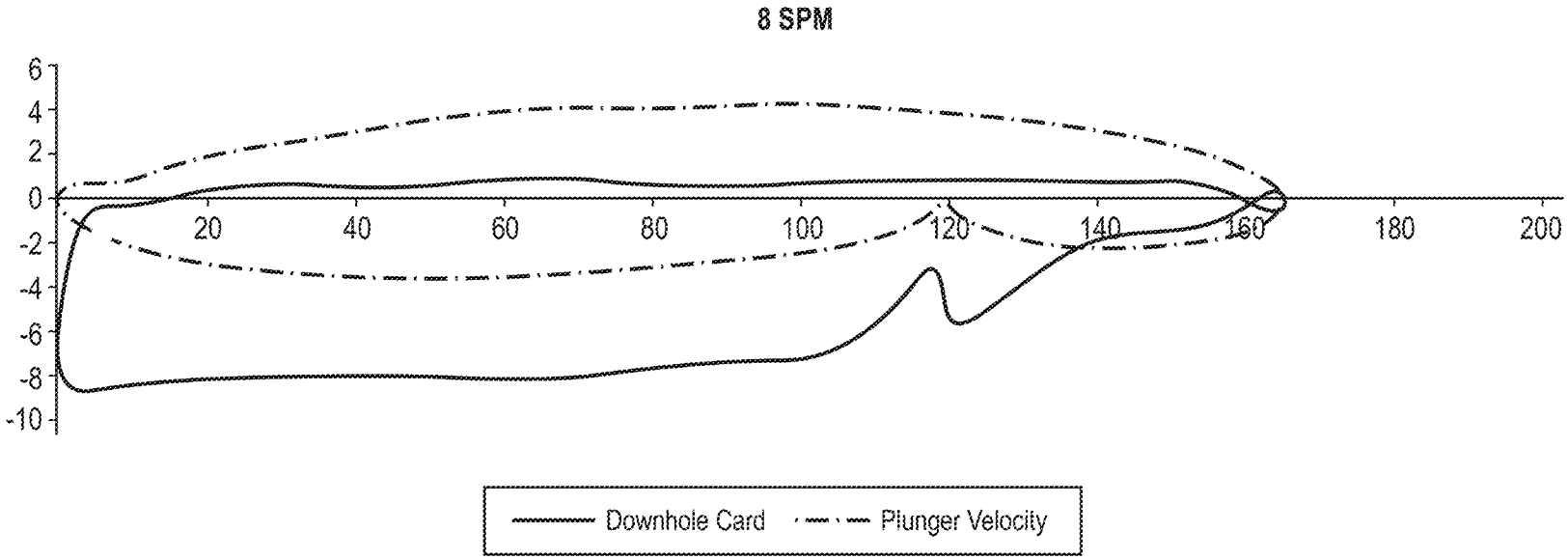
Figure 6H:
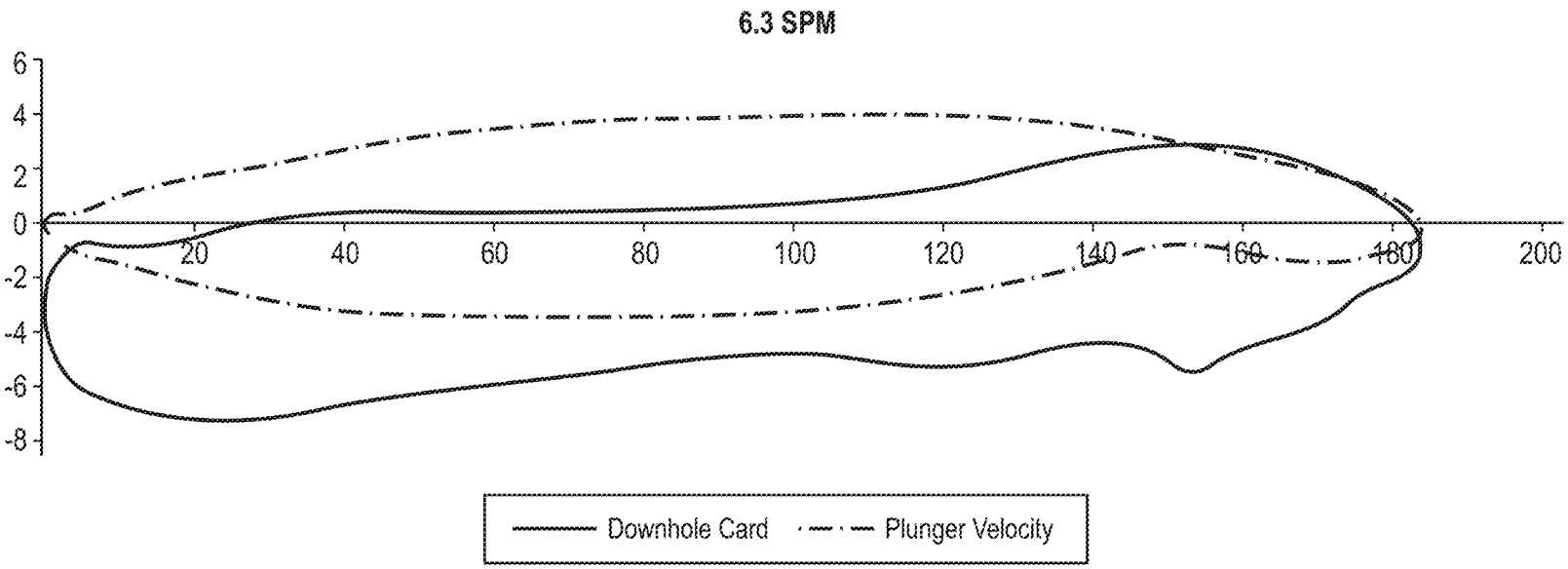
Figure 6I:
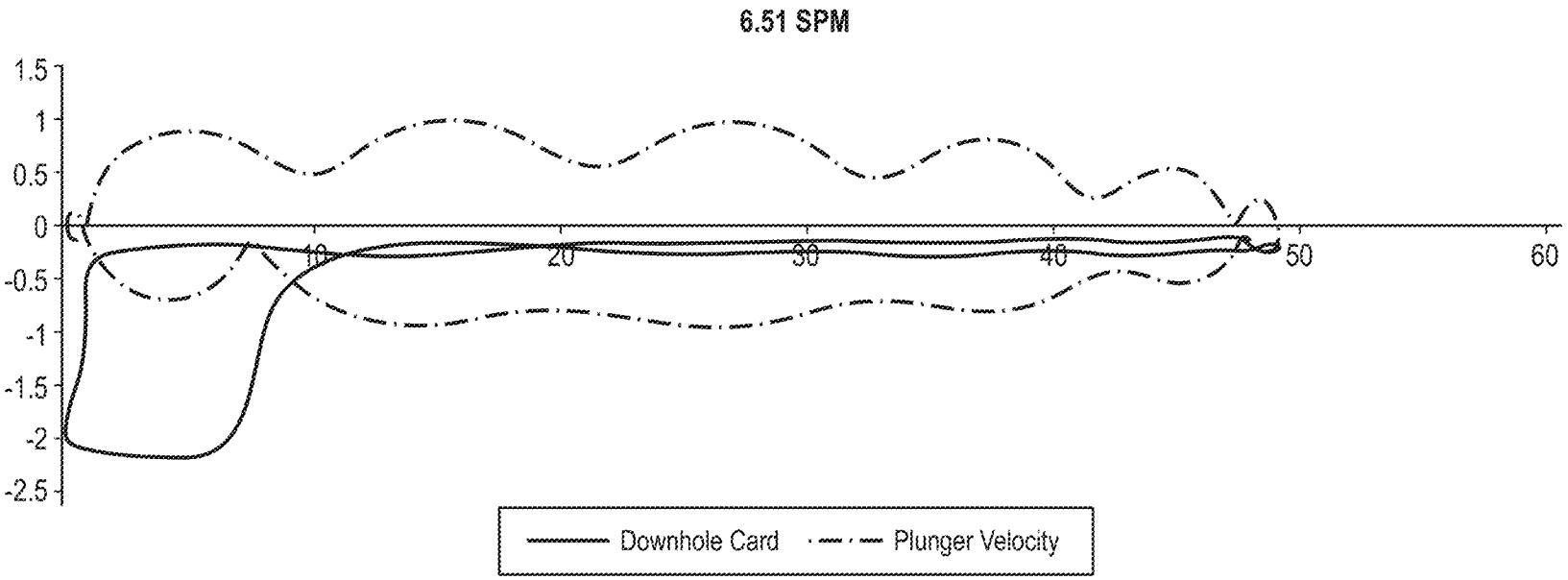
Figure 6J:
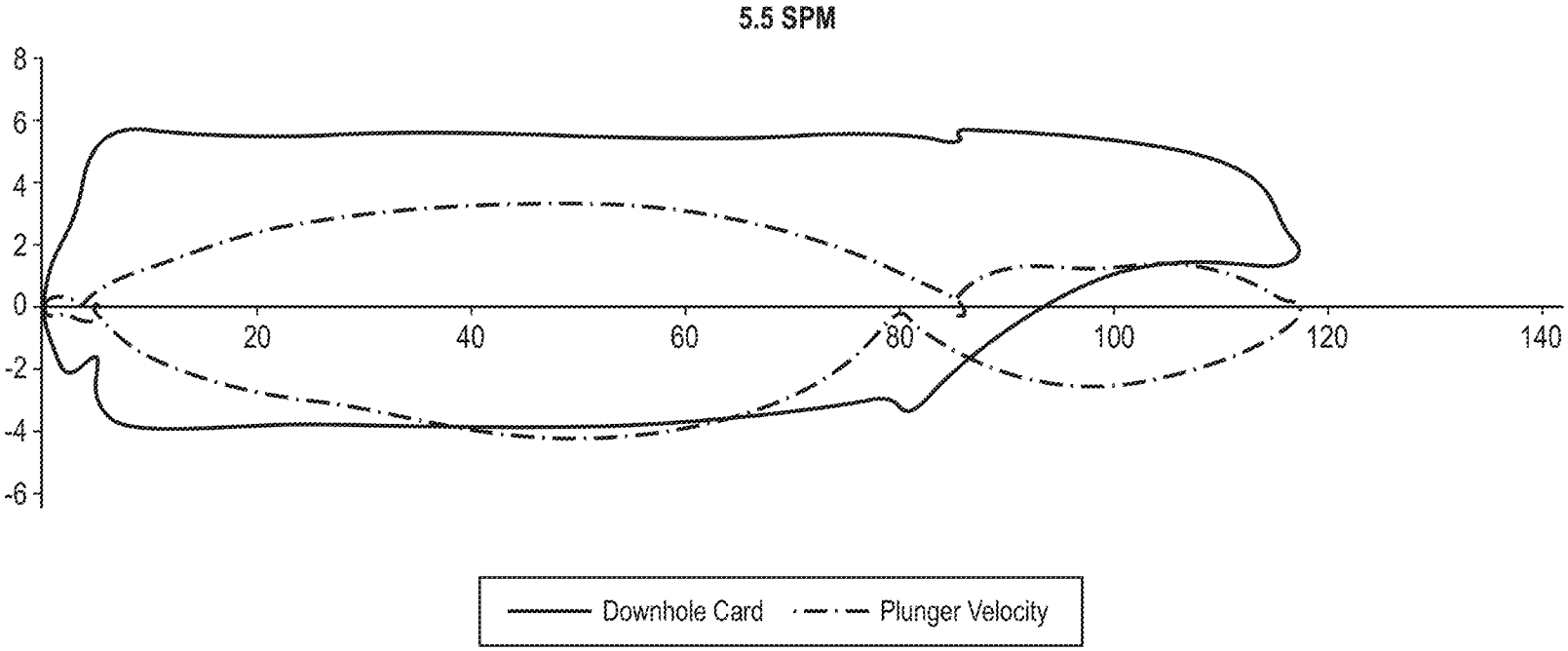
Figure 6K:
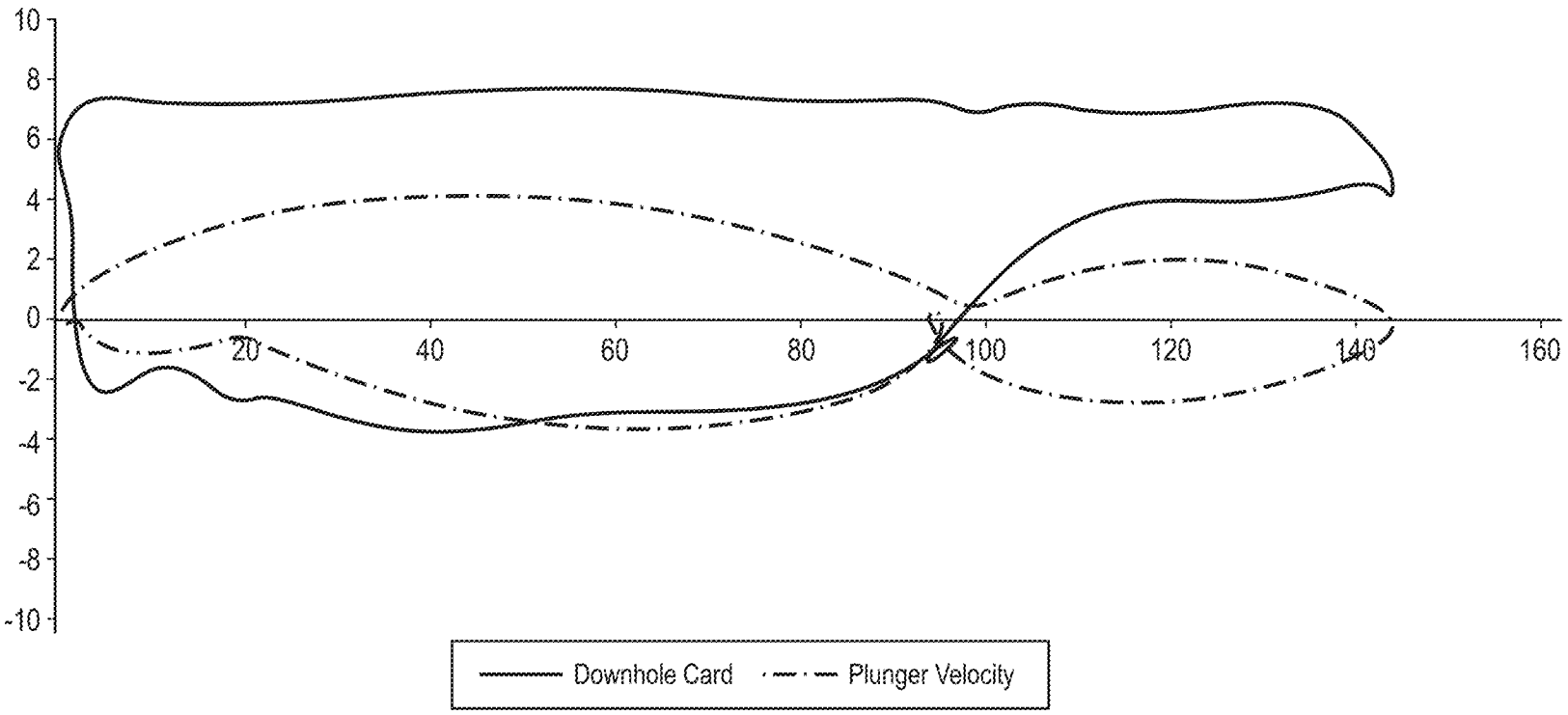
Figure 6L:
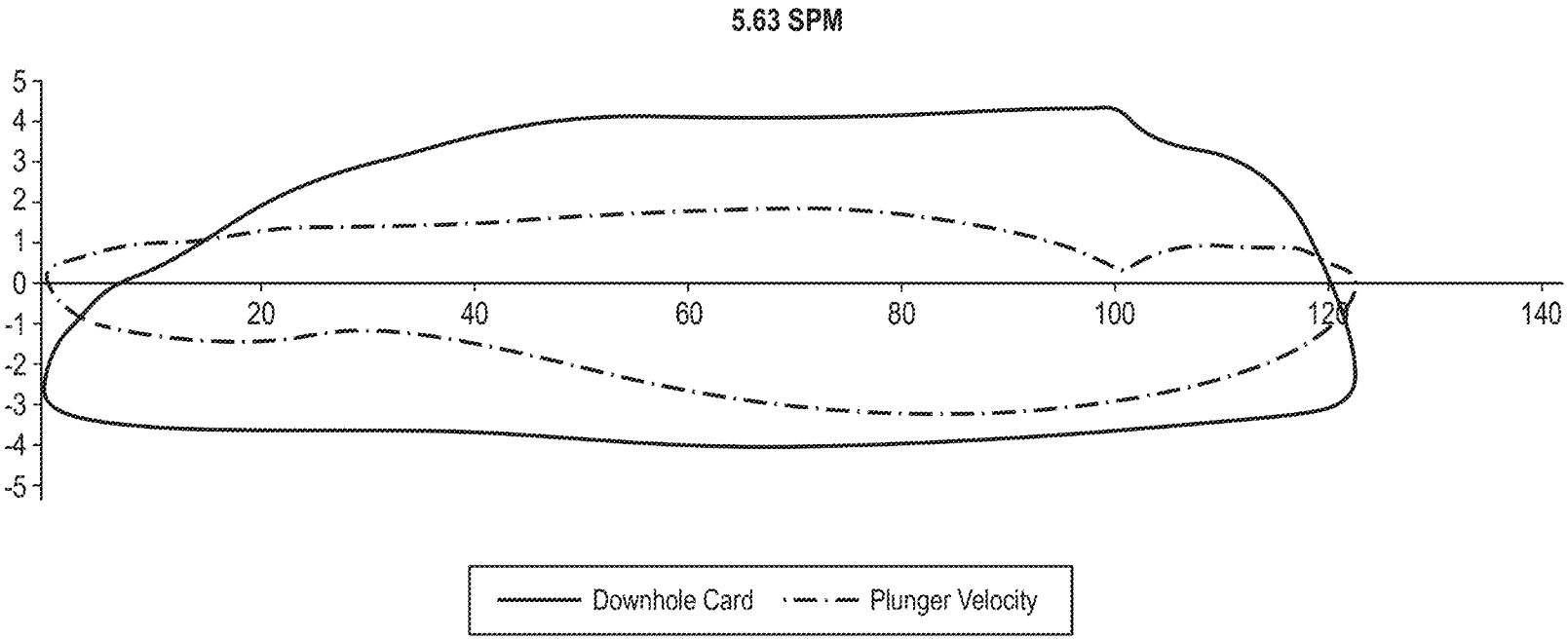
Figure 6M:
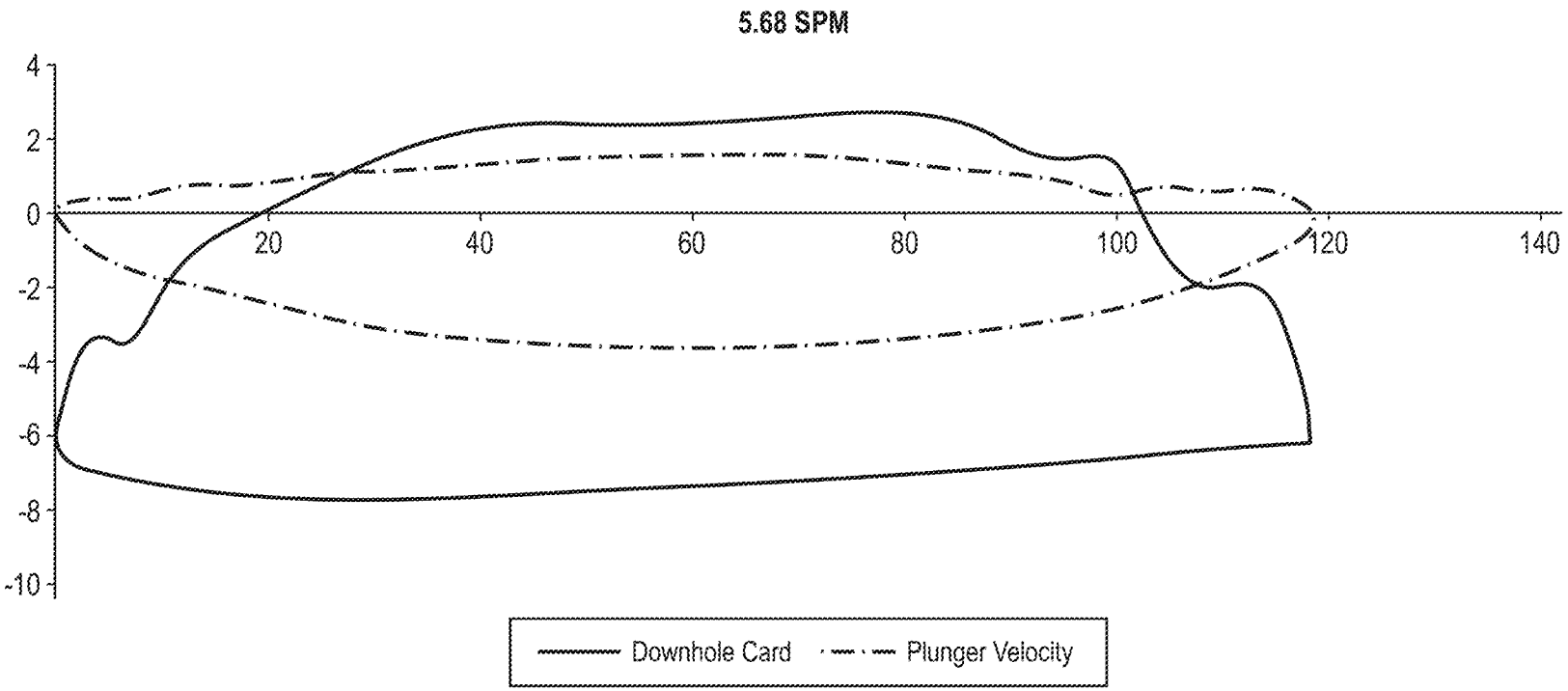
Figure 6N:
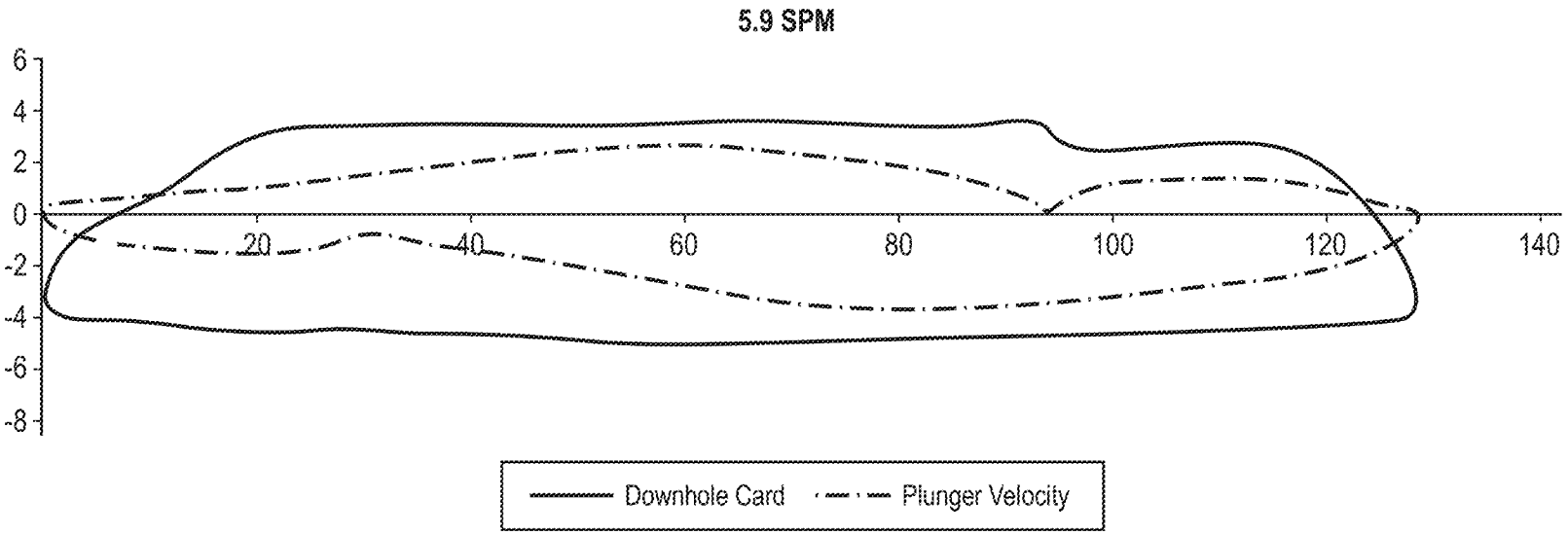
Figure 6O:
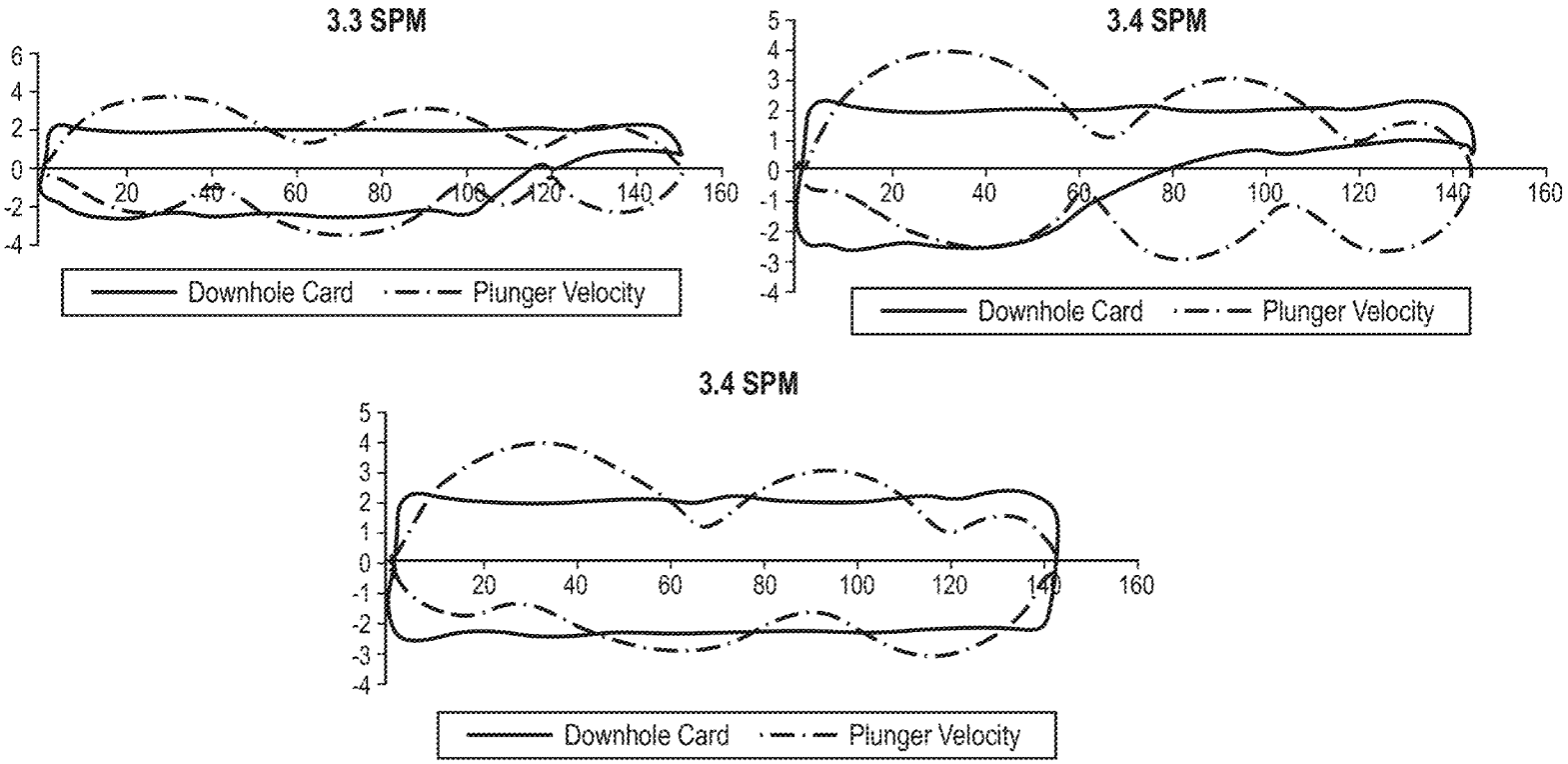
Figure 6P:
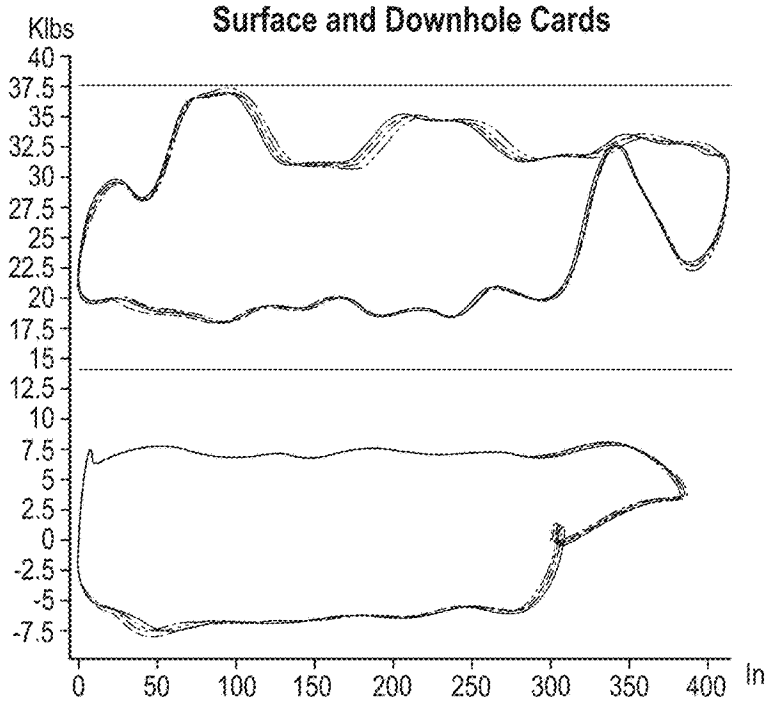
Figure 6P:
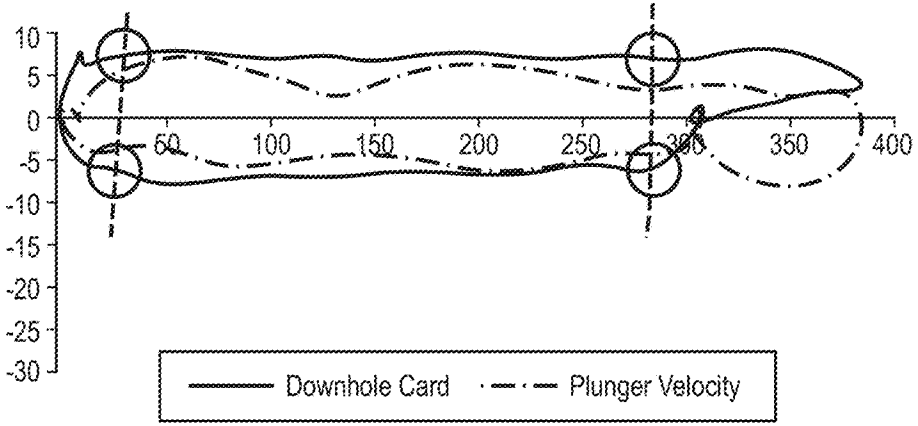
Figure 6Q:
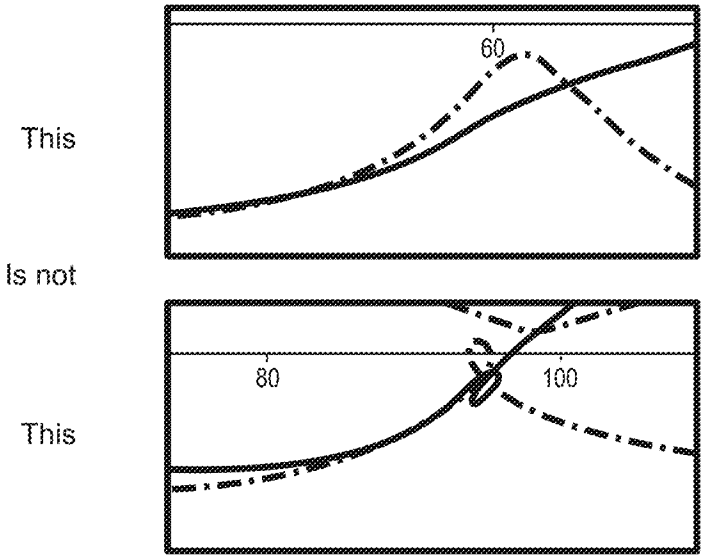

FIGS. 6A through 6Q show various examples of plunger velocity and downhole card scenarios. In each plot the downhole card is shown as a solid line and plunger velocity is shown as a dashed and dotted line. These examples are again meant to be illustrative and not limiting.

FIG. 6A shows a longstroke pumping unit. This example helps to show that zone control speed changes can make fluid pound look like gas interference. When zone control was enabled correctly, the fluid pound card became more apparent. This well has severe hitch signature on downstroke of the surface card.

FIG. 6B shows a longstroke pumping unit. This example shows that no rod buckling/tubing slap occurring during gas interference conditions. This shows plunger speed dynamics with speed changes within the stroke.

FIG. 6C shows a longstroke pumping unit at 3.11 SPM. In this example, there is a tweener card with cornering enabled. This shows plunger speed dynamics with speed changes within the stroke.

FIGS. 6D-6H shows conventional pumping units with gas interference and variations of a gradual curve of the plunger velocity illustrates leading to TVO (traveling valve open).

FIGS. 6I-6J show a conventional pumping unit with tagging verified and identified with plunger velocity. In these examples the slope is less severe where TV opens after compression, whereas the slope of the tag is vertical and much more violent.

FIG. 6K shows a conventional unit at 6.85 SPM with effects of pump off captured in plunger velocity.

FIGS. 6L-6N show variations of a conventional pumping unit with leaky TV. It can be seen how the plunger velocity is half the speed of the upstroke vs. the downstroke.

FIG. 6O shows variations of a conventional pumping unit running at 3.3 SPM. The change in plunger velocity is captured as gas interference severity changes.

FIG. 6P shows variations of a longstroke pumping unit with cornering enabled. The jump on downstroke is not the TVO, it is showing the effects of the VFD speeding up on the downstroke. The jump on downstroke should be pushed to the left, past the TVO point to optimize.

FIG. 6Q illustrates two downhole cards that are not equivalent. The current disclosure helps to illustrate how the two plots show different operating characteristics.

There are several takeaways from the examples shown in FIGS. 6A-6Q. In general, a gradual curve indicates a slight plunger speed reduction over time, whereas a more vertical slope change towards the zero line would indicate a more violent or sudden speed reduction. This helps with other analytics and allows for other capabilities as described herein. It is desired to plot plunger velocity on every stroke at the controller level, as opposed to rod designs only. The TVO point and/or pump fillage pick should be verified. This can help with tag identification and verification. Effects of stuffing box friction on plunger velocity can be detected. Embodiments can provide optimized zone control, such as longstroke vs conventional units. Embodiments can quantify a delta between gas compression, fluid pound, and tag.

Figure 7:
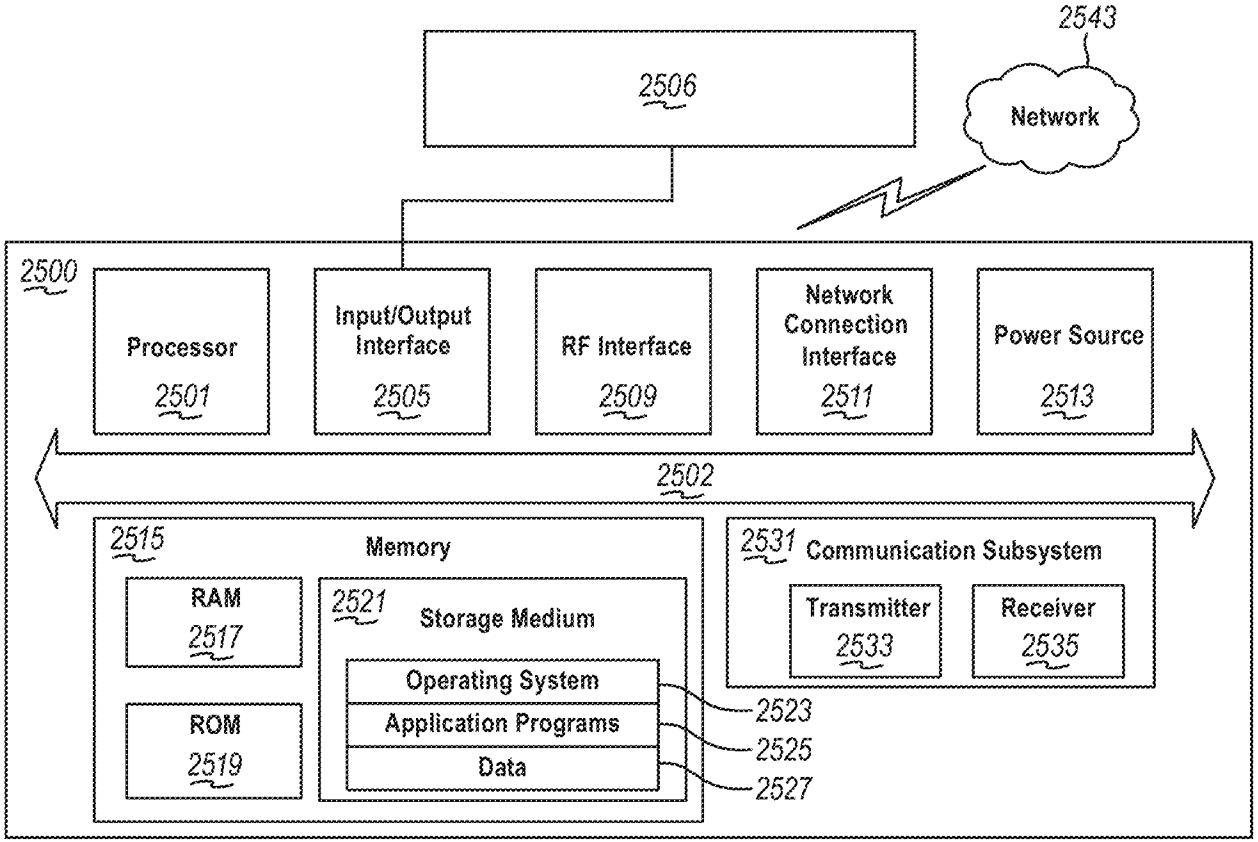
FIG. 7 illustrates possible computing device embodiments under the present disclosure.

FIG. 7 illustrates an embodiment of various computing devices within pump assembly 12 or well 10 of FIG. 1, or components thereof e.g., computing devices 90, controller 40, sensors 45 (for e.g., temperature, pressure, flow rate, speed, etc.), or other computing or smart devices described herein. Computing devices could comprise computers, tablets, smartphones, servers, network nodes, hosts, combination of the foregoing, etc. FIG. 4 shows a schematic block diagram of a computing device 2500 (or components thereof) according to certain embodiments of the present disclosure. Computing device 2500 can be used to analyze and/or optimize: the functionalities described with respect to e.g., computing devices 90, controller 40, sensors 45, or other computing or smart devices described herein, or to perform other methods, such as artificial intelligence or machine learning-related tasks and analyses as described herein.

Computing device 2500 includes processor 2501 that is operatively coupled via a bus 2502 to an input/output interface 2505, a power source 2513, a memory 2515, a RF interface 2509, network communication interface 2511, and/or any other component, or any combination thereof. The level of integration between the components may vary from one embodiment to another. Further, certain computing devices 2500 (or components thereof) may contain multiple instances of a component, such as multiple processors, memories, transceivers, transmitters, receivers, etc.

The processor 2501 is configured to process instructions and data and may be configured to implement any sequential state machine operative to execute instructions stored as machine-readable computer programs in memory 2515. Processor 2501 may be implemented as one or more hardware-implemented state machines (e.g., in discrete logic, field-programmable gate arrays (FPGAs), application specific integrated circuits (ASICs), etc.); programmable logic together with appropriate firmware; one or more stored computer programs, general-purpose processors, such as a microprocessor or digital signal processor (DSP), together with appropriate software; or any combination of the above. For example, the processor 2501 may include multiple central processing units (CPUs).

In the example, input/output interface 2505 may be configured to provide an interface or interfaces to an input/output device(s) 2506, such as a screen, keyboard, indicator light, keypad, touchscreen, or other input or output device. Other examples of an output device include a speaker, a sound card, a video card, a display, a monitor, a printer, an actuator, an emitter, a smartcard, another output device, or any combination thereof. An input device may allow a user to capture information into system 2500. Other examples of an input device include a touch-sensitive or presence-sensitive display, a camera (e.g., a digital camera, a digital video camera, a web camera, etc.), a microphone, a sensor, a mouse, a trackball, a directional pad, a trackpad, a scroll wheel, a smartcard, and the like. The presence-sensitive display may include a capacitive or resistive touch sensor to sense input from a user. A sensor may be, for instance, an accelerometer, a gyroscope, a tilt sensor, a force sensor, a magnetometer, an optical sensor, a proximity sensor, a biometric sensor, etc., or any combination thereof. An output device may use the same type of interface port as an input device. For example, a Universal Serial Bus (USB) port may be used to provide an input device and an output device.

In some embodiments, the power source 2513 is structured as a battery or battery pack. Other types of power sources, such as an external power source (e.g., an electricity outlet, or motor 13 of FIG. 1), photovoltaic device, or power cell, may be used. The power source 2513 may further include power circuitry for delivering power from the power source 2513 itself, and/or an external power source, to the various parts of computing device 2500 via input circuitry or an interface such as an electrical power cable.

Memory 2515 may be configured to include memory such as random access memory (RAM) 2517, read-only memory (ROM) 2519, programmable read-only memory (PROM), erasable programmable read-only memory (EPROM), electrically erasable programmable read-only memory (EEPROM), magnetic disks, optical disks, hard disks, removable cartridges, flash drives, other storage medium 2521, and so forth. In one example, the memory 2515 includes one or more application programs 2525, an operating system 2523, web browser application, a widget, gadget engine, or other application, and corresponding data 2527. Memory 2515 may store, for use by the computing device 2500, any of a variety of various operating systems or combinations of operating systems. An article of manufacture, such as one including a simulation system or communication system may be tangibly embodied as or in memory 2515, which may be or comprise a device-readable storage medium.

Processor 2501 may be configured to communicate with an access network or other network using the RF interface 2509 or network connection interface 2511. The RF interface 2509 or network connection interface 2511 may comprise one or more communication subsystems and may include or be communicatively coupled to an antenna. In the illustrated embodiment, communication functions of the RF interface 2509 or network connection interface 2511 may include cellular communication, Wi-Fi communication, LPWAN communication, data communication, voice communication, multimedia communication, short-range communications such as Bluetooth, near-field communication, location-based communication such as the use of the global positioning system (GPS) to determine a location, another like communication function, or any combination thereof.

Figure 8:
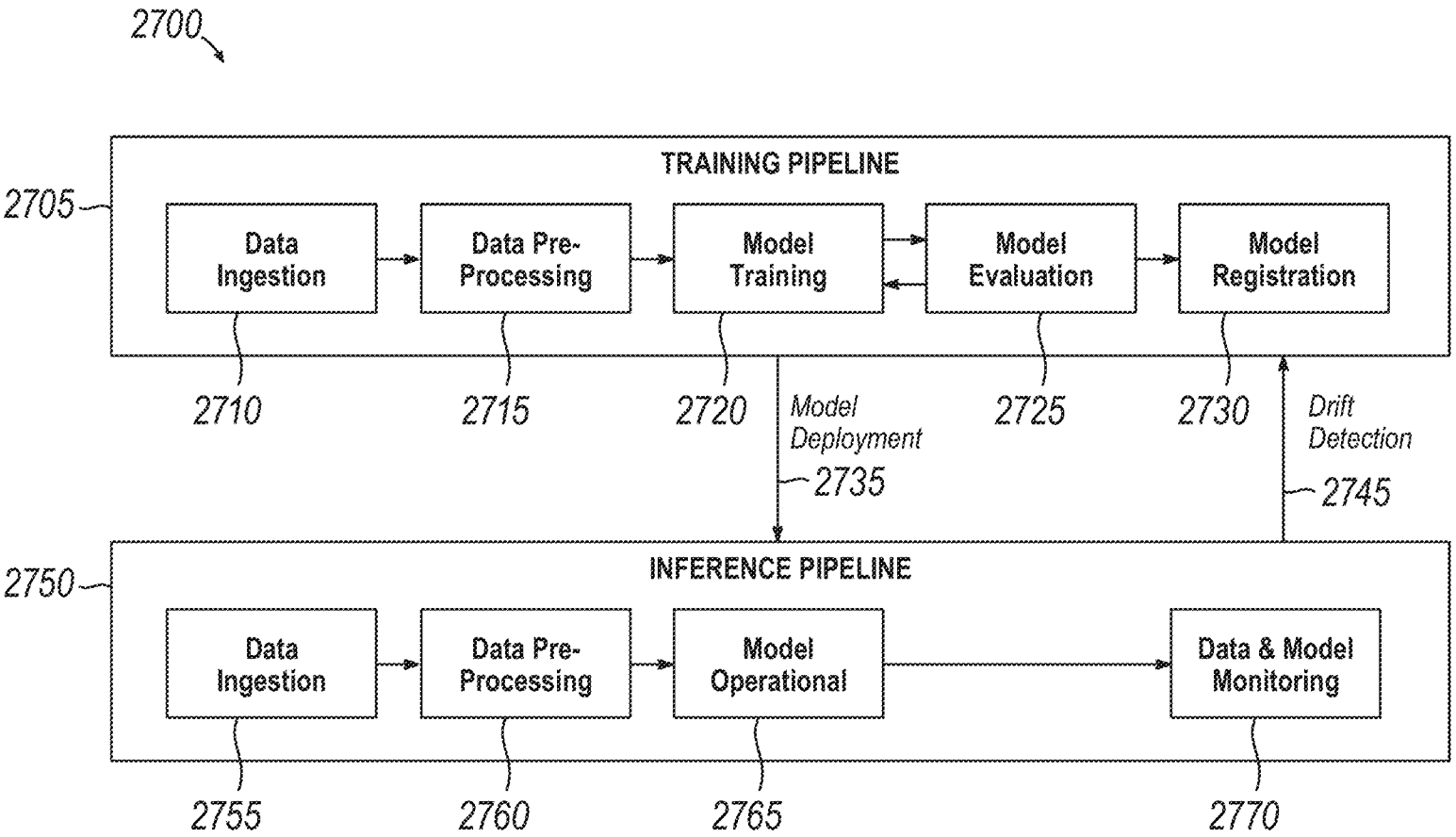
FIG. 8 illustrates an example flow chart of training and inference pipelines for machine learning in accord with some embodiments under the present disclosure.

In certain embodiments under the present disclosure, the data collected by controller 40 and/or computing devices 90 of FIG. 1 can be used to make predictions about, or implement AI/ML capabilities with respect to, the functionality, wear and tear, oil properties or other valuable variables or parameters with well 10 or pump assembly 12. Building an AI/ML engine can include several development steps where the actual training of a ML model or algorithm is just one step in a training pipeline. An important part in AI/ML development is AI/ML model lifecycle management. One embodiment of a model lifecycle management procedure 2700 is illustrated in FIG. 8. The model lifecycle management can in some embodiments comprise two pipelines: a training pipeline 2705 and an inference pipeline 2750.

At 2710 in the training pipeline 2705, data ingestion 2710 occurs, which includes gathering raw (training) data from a data storage. After data ingestion 2710, there may also be a step that controls the validity of the gathered data. At 2715 data pre-processing occurs, which can include feature engineering applied to the gathered data. This may involve, e.g., data normalization or data formatting or transformation required for the input data to the AI/ML model. After the ML model's architecture is fixed, it should be trained on one or more datasets. At 2720 model training is performed in which the AI/ML model is trained with the raw training data. To achieve good performance during live operation in a system (the so-called inference phase), the training datasets should be representative of actual data the ML model will encounter during live operation. The training process often involves numerically tuning the ML model's trainable parameters (e.g., the weights and biases of the underlying neural network (NN)) to minimize a loss function on the training datasets. The loss function may be, for example, based on a maximizing student learning (possibly against a standardized test or other measure); minimizing disruptive behavior; minimizing teacher hours spent on lesson plans, or other metrics. The purpose of the loss function is to meaningfully quantify the reconstruction error for the particular use case at hand. At 2725 model evaluation can be performed where the performance is benchmarked to some baseline. Model training 2720 and evaluation 2725 can be iterated until an acceptable level of performance is achieved. At 2730 model registration occurs, in which the AI/ML model is registered with any corresponding data on how the AI/ML model was developed, and e.g., AI/ML model evaluation data. At 2735 model deployment occurs, wherein the trained/re-trained AI/ML model is implemented in the inference pipeline 2750.

Data ingestion 2755 in the inference pipeline 2750 refers to gathering raw (inference) data from a data source. Data pre-processing 2760 can be essentially identical/similar to the data pre-processing 2715 of the training pipeline 2705. At 2765, the operational model received from the training pipeline 2705 is used to process new data received during operation of e.g., well 10 of FIG. 1 or components thereof. At 2770 data and model monitoring is performed. Here the inference data is analyzed to determine whether the inference data are from a distribution that aligns with the training data, as well as monitoring model outputs for detecting any performance, or operational, variance or drifts. The variance or drift is used at 2745 (drift detection) to update the AI/ML model registration.

The training process is typically based on some variant of a gradient descent algorithm, which, at its core, typically comprises three components: a feedforward step, a back propagation step, and a parameter optimization step. These steps can be described using a dense ML model (i.e., a dense NN with a bottleneck layer) as an example.

Feedforward: A batch of training data, such as a mini-batch, (e.g., several downlink-channel estimates) is pushed through the ML model, from the input to the output. The loss function is used to compute the reconstruction loss for all training samples in the batch. The reconstruction loss may be an average reconstruction loss for all training samples in the batch.

Back propagation (BP): The gradients (partial derivatives of the loss function, L, with respect to each trainable parameter in the ML model) are computed. The back propagation algorithm sequentially works backwards from the ML model output, layer-by-layer, back through the ML model to the input. The back propagation algorithm is built around the chain rule for differentiation: When computing the gradients for layer n in the ML model, it uses the gradients for layer n+1.

Parameter optimization: The gradients computed in the back propagation step are used to update the ML model's trainable parameters. An approach is to use the gradient descent method with a learning rate hyperparameter (a) that scales the gradients of the weights and biases. It is preferred to make small adjustments to each parameter with the aim of reducing the average loss over the (mini) batch. It is common to use special optimizers to update the ML model's trainable parameters using gradient information. The following optimizers are widely used to reduce training time and improve overall performance: adaptive sub-gradient methods (AdaGrad), RMSProp, and adaptive moment estimation (ADAM).

The above process (feedforward, back propagation, parameter optimization) can be repeated many times until an acceptable level of performance is achieved on the training dataset. An acceptable level of performance may refer to the ML model achieving a pre-defined average reconstruction error over the training dataset (e.g., normalized MSE of the reconstruction error over the training dataset is less than, say, 0.1). Alternatively, it may refer to the ML model achieving a pre-defined value chosen by a user.

In some implementations, a function F (·) may be generated by a ML process, such as, for example, supervised learning, reinforcement learning, and/or unsupervised learning. It should further be understood that supervised learning may be done in various ways, such as, for example, using random forests, support vector machines, neural networks, and the like. By way of non-limiting example, any of the following types of neural networks that may be utilized, including, deep neural networks (DNNs), convolutional neural networks (CNNs), and recurrent neural networks (RNNs), or any other known or future neural network that satisfies the needs of the system. In an implementation using supervised learning the neural networks may be easily integrated into the hardware described in well 10 of FIG. 1 (e.g., in the form of simple vector-matrix multiplications).

Figure 9:
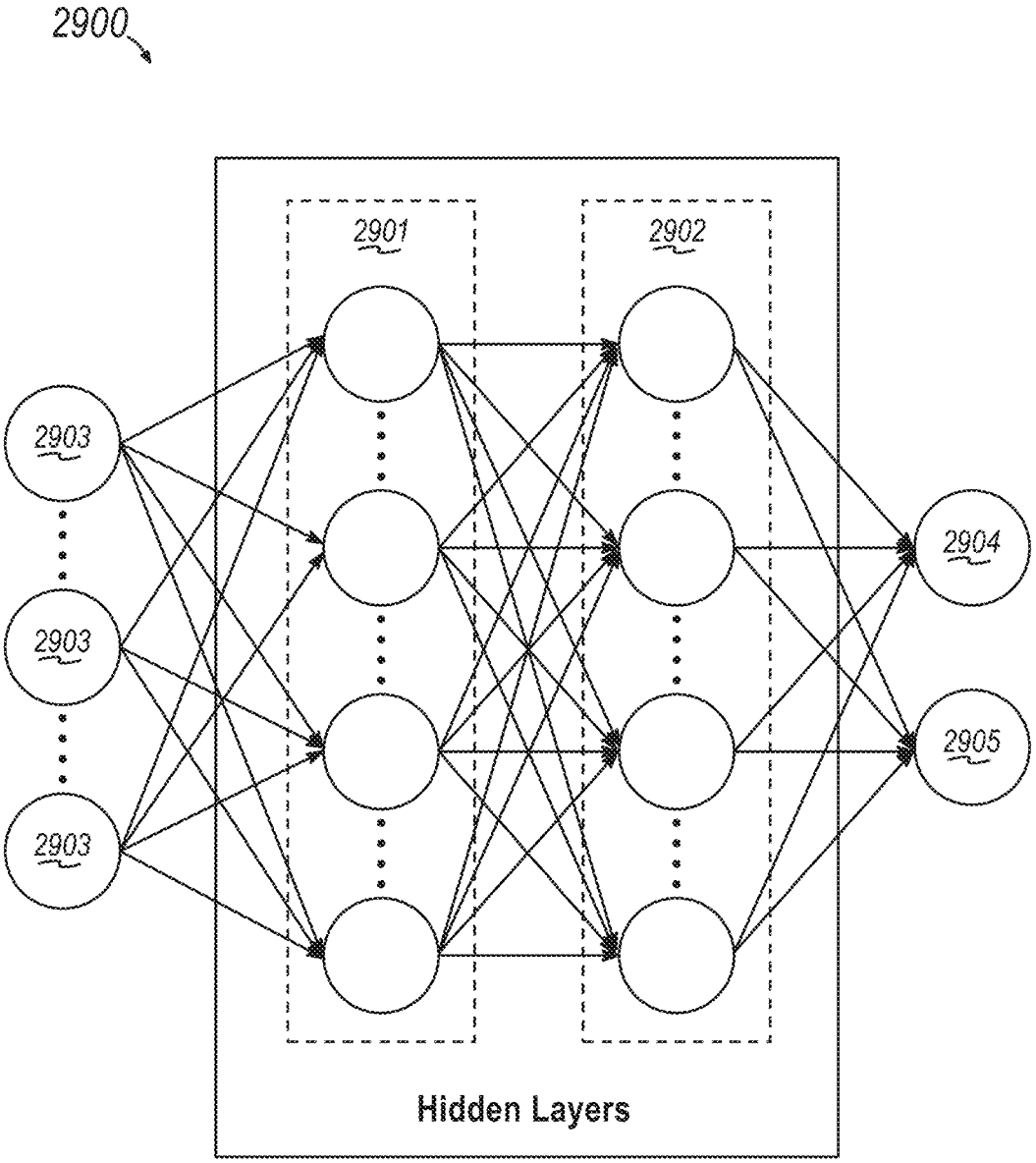
FIG. 9 illustrates an embodiment of a neural network under the present disclosure.

Referring now to FIG. 9, an example NN 2900 (e.g., DNN) is shown. In some implementations, and as shown, the neural network 2900 may include two hidden layers represented by dashed boxes 2901 and 2902. In one implementation, the inputs 2903 may be fed into the NN 2900. Next, the inputs 2403 may go through a set of hidden layers (e.g., 2901 and/or 2902). Once the inputs 2903 pass though the hidden layers 2901 and/or 2902, they may be output (e.g., as an output layer) as outputs 2904, 2905 e.g., pump flow rate, pump life time; pump operating costs; or another output valuable for e.g., well 10 or pump assembly 12 analysis. Possible inputs can include e.g.: plunger velocity, pump flow rate, component identifications, or other operating characteristics or variables.

As should be understood by one of ordinary skill in the art, in order for the NN 2900 to output proper a proper analysis, it should be trained properly (e.g., with a collection of samples) to accurately extract the likelihood values. If not trained properly, overfitting (e.g., when the NN memorizes the structure of the preambles but is unable to generalize to unseen preamble characteristics) or underfitting (e.g., when the NN is unable to learn a proper function even on the data that it was trained on) may happen. Thus, implementations may exist that prevent overfitting or underfitting, involving a set of well-engineered features that must be extracted from the preamble characteristics.

Figure 10:
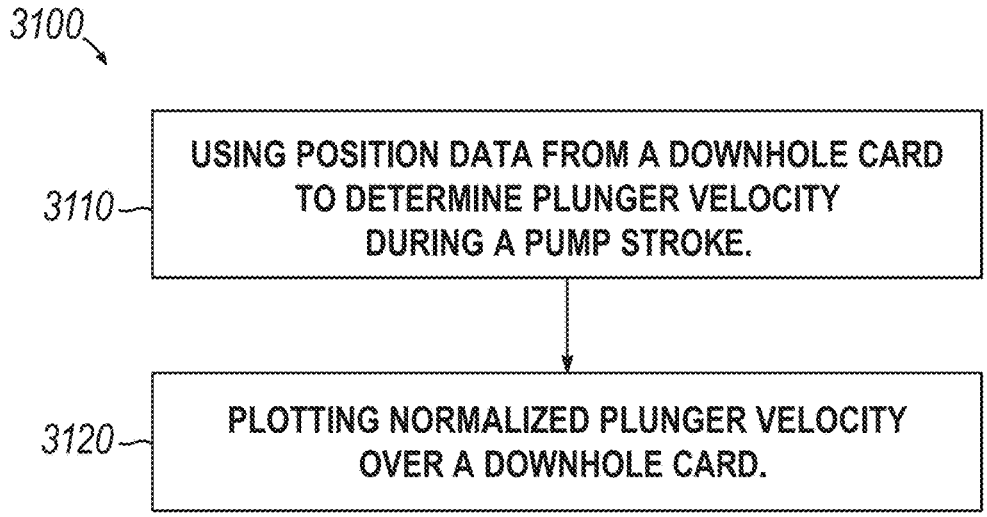
FIG. 10 illustrates a flow-chart of a method embodiment under the present disclosure.

FIG. 10 illustrates one possible method embodiment under the present disclosure. Method 3100 is a method for determining plunger velocity in a rod pumped well. Step 3110 is using position data from a downhole card to determine plunger velocity during a pump stroke. Step 3120 is plotting normalized plunger velocity over a downhole card. Method 3100 can comprise a variety of additional, alternative, or optional steps. Some variations can further comprise driving the plunger cyclically in a vertical direction. Some variations, wherein the plunger includes a series of valves, can further comprise driving a fluid upwards using the series of valves. Some variations, wherein the series of valves including a traveling valve, can further comprise driving the plunger in a downwards direction to thereby open the traveling valve and driving the plunger upwards to thereby close the traveling valve. In some variations the plot includes e.g. plunger velocity versus plunger position or an entire pump stroke. Some variations can further comprise determining the plunger velocity in real time. Some variations can further comprise normalizing the downhole card to thereby plot the plunger velocity over the downhole card.

Some variations can further comprise changing the plunger velocity based on the plot. Some variations, wherein the rod pumped well includes a motor operable attached to the plunger to thereby drive the plunger, the method can further include changing a drive frequency of the motor based on the plot to thereby change the plunger velocity. Some variations, wherein the plunger being operatively attached to a rod, the method can further include using the plunger velocity to identify whether the rod has buckled. Some variations can further comprise using the plunger velocity to identify a moment a traveling valve opens to thereby improve up-pump fillage pick algorithms on the rod pump well. Some variations can further comprise using plunger velocity to differentiate between gas interference and pumped off conditions on the rod pump well. Some variations can further comprise using the plunger velocity to allow a system to automatically optimize parameters while avoiding buckling or tagging conditions on the rod pump well. Some variations can further comprise allowing a user to setup intra-stroke speed control to prevent rod buckling of a rod operatively attached to the plunger. Some variations can further comprise using the plot to drive the plunger to include a slow downstroke and a fast upstroke to thereby limit gas interference conditions. Some variations can further comprise lowering the plunger velocity at an upper plunger position and increasing the plunger velocity at a lower plunger position based on the plot. Some variations can further comprise lowering the plunger velocity during a compression event of the plunger based on the plot. Some variations can further include mitigating the buckling or tapping by controlling the speed of the well or powering on/off the well. Some variation can further comprise using the plunger velocity to determine a leak. Some variation can further include using the overlay of velocity in the downhole card to determine critical velocity or the point at which the standing valve opens. Some embodiments can further comprise determining leakage based at least in part on the critical velocity.

Figure 11:
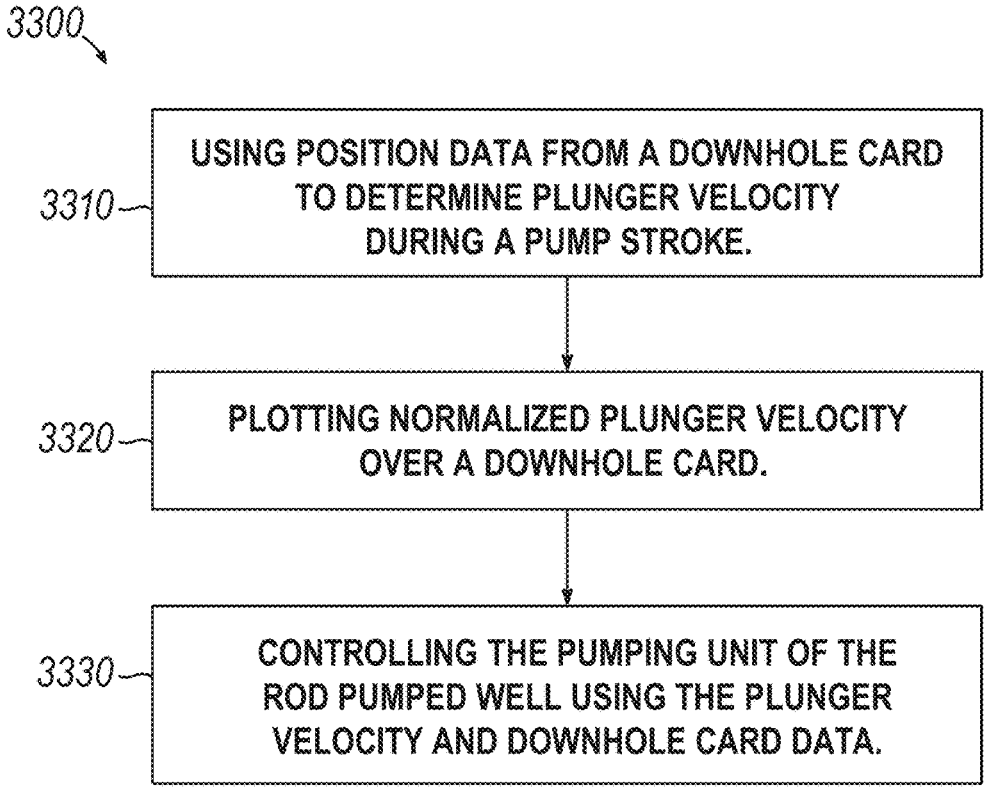
FIG. 11 illustrates a flow-chart of a method embodiment under the present disclosure.

FIG. 11 shows another possible method embodiment under the present disclosure. Method 3300 is a method for determining plunger velocity in a rod pumped well. Step 3310 is using position data from a downhole card to determine plunger velocity during a pump stroke. Step 3320 is plotting normalized plunger velocity over a downhole card. Step 3330 is controlling the pumping unit of the rod pumped well using the plunger velocity and downhole card data. Method 3300 can comprise a variety of additional, alternative, or optional steps, such as those set forth regarding method 3100 above. Some embodiments can further comprise detecting rod buckling or tapping of a rod of the rod pumped well based on the plot. Some embodiments can comprise using the plunger velocity to determine a leak. Some embodiments can comprise using the overlay of velocity in the downhole card to determine critical velocity or the point at which the standing valve opens. Some variations can further comprise determining leakage based at least in part on the critical velocity. Some variations can further comprise using plunger velocity as an input for a controller comprising the oil well.

Figure 12:
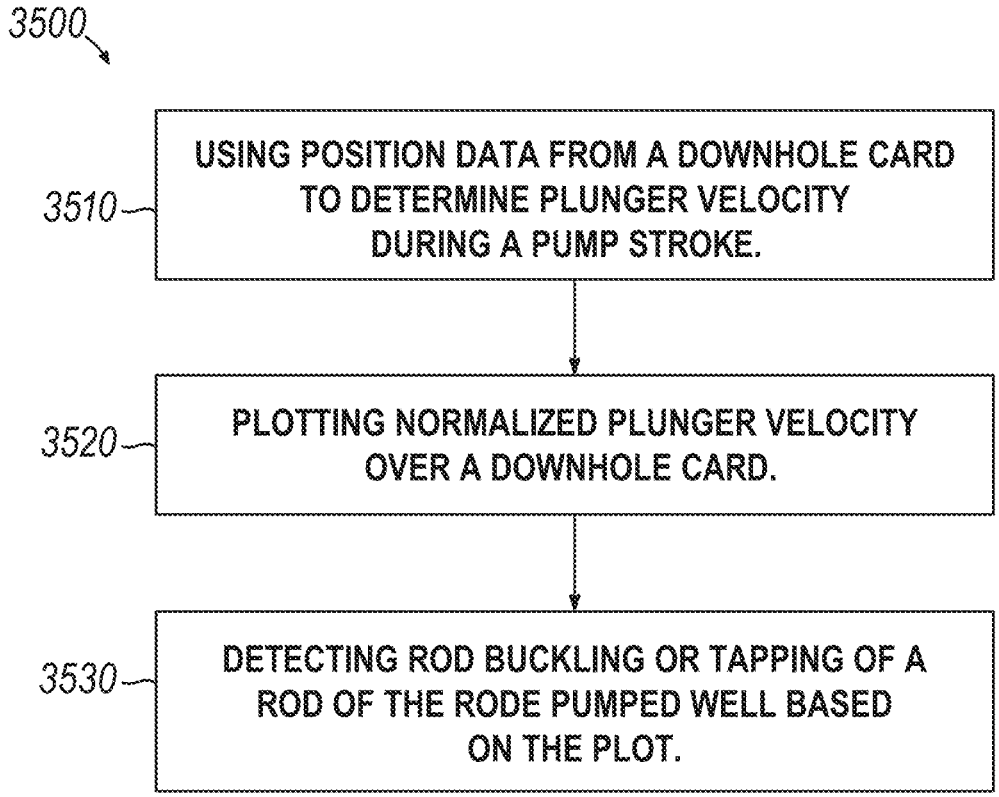
FIG. 12 illustrates a flow-chart of a method embodiment under the present disclosure.

FIG. 12 shows another possible method embodiment under the present disclosure. Method 3500 is a method for determining plunger velocity in a rod pumped well. Step 3510 is using position data from a downhole card to determine plunger velocity during a pump stroke. Step 3520 is plotting normalized plunger velocity over a downhole card. Step 3530 is detecting rod buckling or tapping of a rod of the rode pumped well based on the plot. Method 3500 can comprise a variety of additional, alternative, or optional steps, such as those set forth regarding method 3100 or 3300 above. Some variations can further include mitigating the buckling or tapping by controlling the speed of the well or powering on/off the well. Some variation can further comprise using the plunger velocity to determine a leak. Some variation can further include using the overlay of velocity in the downhole card to determine critical velocity or the point at which the standing valve opens. Some embodiments can further comprise determining leakage based at least in part on the critical velocity.

Figure 13:
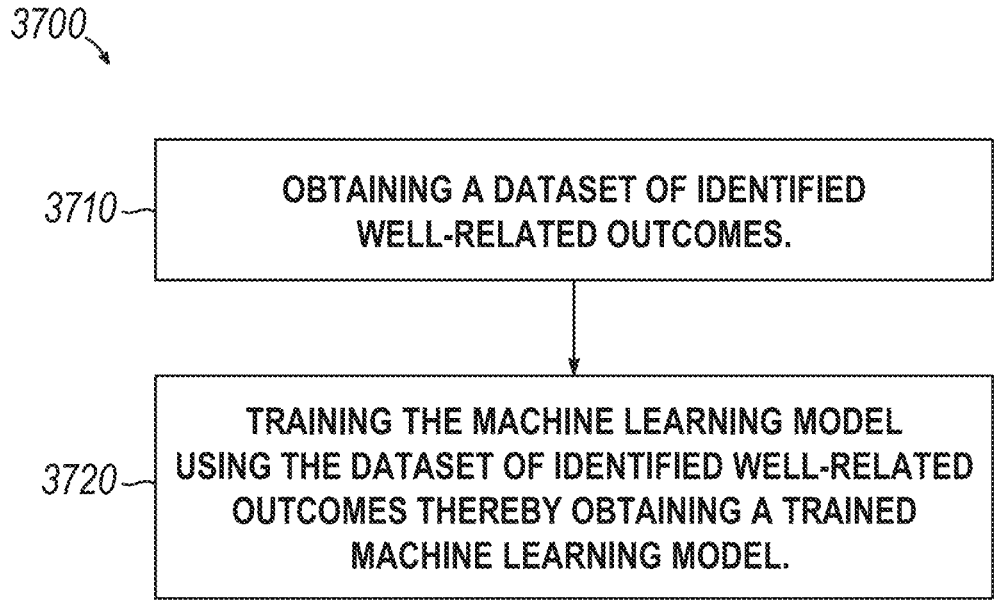
FIG. 13 illustrates a flow-chart of a method embodiment under the present disclosure.

FIG. 13 shows another possible method embodiment under the present disclosure. Method 3700 comprises a computer implemented method for training a machine learning model for optimizing oil well operations. Step 3710 is obtaining a dataset of identified well-related outcomes. Step 3720 is training the machine learning model using the dataset of identified well-related outcomes thereby obtaining a trained machine learning model. Method 3700 can comprise additional, alternative, or optional steps. Some embodiments can further comprise storing the trained machine learning model. Some variation can further comprise further training the machine learning model for optimizing identified well-related outcomes, wherein the training comprises training the machine learning model using a further dataset of one or more identified well-related outcomes, thereby obtaining a further trained machine learning model; and optionally storing the further trained machine learning model. In some embodiments the one or more identified supply-related outcomes comprise one or more of: supply costs, labor costs, pump speed, plunger velocity, total oil pumped, component life length, combinations of the foregoing, or other outputs desired to be optimized. In some embodiments, wherein the machine learning model uses one or more inputs, the one or more inputs can comprise one or more of: sensor data, plunger velocity, component identification, pump flow rate, pump intake pressure, temperatures, combinations of the foregoing, or any other well-related data. Some embodiments can further comprise predicting future oil well operations based at least in part on the trained or stored machine learning models, and/or optionally taking remediating or corrective actions in response to the predicting.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An oil well, comprising:

a well assembly comprising:

a casing extending toward an oil bearing region;

a tubing extending at least partially through the casing;

a sucker rod extending at least partially through the tubing;

a plunger coupled to the sucker rod and configured to create an upstroke and downstroke in the oil bearing region to extract oil from the oil bearing region into the casing;

a pump assembly coupled to the well assembly and comprising:

a motor configured to supply power to the pump assembly and the well assembly;

a gear box configured to direct power from the motor to the well assembly and the sucker rod;

one or more sensors configured to detect one or more properties within the oil well, wherein the one or more properties includes position data of the plunger; and a controller communicatively coupled to the one or more sensors and configured to control the pump assembly and the well assembly, the controller comprising:

one or more processors; and a non-transitory, computer-readable storage medium in operable communication with at least one processor of the one or more processors, wherein the computer-readable storage medium contains one or more programming instructions that, when executed, cause the at least one processor to:

create a downhole card based at least in part on the one or more properties from the one or more sensors;

determine plunger velocity during a pump stroke using position data from the downhole card; and generate a plot of normalized plunger velocity over the downhole card, wherein the one or more programming instructions, when executed, further cause the at least one processor to:

identify a moment that a traveling valve opens using the plunger velocity to improve up-pump fillage pick algorithms on a rod pumped well.

2. The oil well of claim 1, wherein the one or more programming instructions, when executed, further cause the at least one processor to:

change the plunger velocity based on the plot.

3. The oil well of claim 1, wherein the rod pumped well includes the motor operably attached to the plunger and configured to drive the plunger, wherein the one or more programming instructions, when executed, further cause the at least one processor to;

change a drive frequency of the motor based on the plot to change the plunger velocity.

4. The oil well of claim 1, wherein the one or more programming instructions, when executed, further cause the at least one processor to:

identify whether the sucker rod has buckled using the plunger velocity.

5. The oil well of claim 1, wherein the one or more programming instructions, when executed, further cause the at least one processor to:

identify a difference between gas interference and pumped off conditions on the rod pumped well using the plunger velocity.

6. The oil well of claim 1, wherein the one or more programming instructions, when executed, further cause the at least one processor to:

change the plunger velocity based on the plot.

7. The oil well of claim 1, wherein the rod pumped well includes the motor operably attached to the plunger and configured to drive the plunger, wherein the one or more programming instructions, when executed, further cause the at least one processor to:

change a drive frequency of the motor based on the plot to change the plunger velocity.

8. The oil well of claim 1, wherein the one or more programming instructions, when executed, further cause the at least one processor to:

identify whether the rod has buckled using the plunger velocity.

9. An oil well, comprising:

a well assembly comprising:

a casing extending toward an oil bearing region;

a tubing extending at least partially through the casing;

a sucker rod extending at least partially through the tubing;

a plunger coupled to the sucker rod and configured to create an upstroke and downstroke in the oil bearing region to extract oil from the oil bearing region into the casing;

a pump assembly coupled to the well assembly and comprising:

a motor configured to supply power to the pump assembly and the well assembly;

a gear box configured to direct power from the motor to the well assembly and the sucker rod;

one or more sensors configured to detect one or more properties within the oil well, wherein the one or more properties includes position data of the plunger; and a controller communicatively coupled to the one or more sensors and configured to control the pump assembly and the well assembly, the controller comprising:

one or more processors; and a non-transitory, computer-readable storage medium in operable communication with at least one processor of the one or more processors, wherein the computer-readable storage medium contains one or more programming instructions that, when executed, cause the at least one processor to:

create a downhole card based at least in part on the one or more properties from the one or more sensors;

use the position data from the downhole card to determine plunger velocity during a pump stroke; and generate a plot of normalized plunger velocity over the downhole card, wherein the one or more programming instructions, when executed, further cause the at least one processor to:

identify a difference between gas interference and pumped off conditions on the rod pumped well using the plunger velocity.

10. The oil well of claim 9, wherein the one or more programming instructions, when executed, further cause the at least one processor to:

identify a moment that a traveling valve opens using the plunger velocity to improve up-pump fillage pick algorithms on the rod pumped well.

11. A method for determining plunger velocity in a rod pumped well comprising a well assembly including a casing extending towards an oil bearing region, a tubing extending at least partially through the casing, a sucker rod extending at least partially through the tubing, a plunger coupled to the sucker rod and configured to create an upstroke and downstroke in the oil bearing region to extract oil from the oil bearing region into the casing, and a pump assembly coupled to the well assembly and including a motor configured to supply power to the pump assembly and the well assembly, a gear box configured to direct power from the motor to the well assembly and the sucker rod, one or more sensors configured to detect properties within the rod pumped well, wherein the one or more properties includes position data of the plunger, and a controller communicatively coupled to the one or more sensors and configured to control the pump assembly and the well assembly, the method comprising:

creating a downhole card based at least in part on the one or more properties from the one or more sensors;

determining the plunger velocity during a pump stroke using the position data from the downhole card;

generating a plot of normalized plunger velocity over the downhole card; and controlling a pumping unit of the rod pumped well using the plunger velocity and plot of the normalized plunger velocity over the downhole card, wherein the method further comprises:

identifying a moment that a traveling valve opens using the plunger velocity to improve up-pump fillage pick algorithms on the rod pump well.

12. The method of claim 11, further comprising:

detecting rod buckling or tapping of a rod of the rode pumped well based on the plot.

13. The method of claim 11, further comprising:

determining a leak using the plunger velocity.

14. The method of claim 11, further comprising:

determining a critical velocity or a point at which a standing valve opens using an overlay of velocity in the downhole card.

15. The method of claim 14, further comprising:

determining leakage based at least in part on the critical velocity.

16. The method of claim 11, further comprising:

receiving the plunger velocity as an input for the controller comprising an oil well.

* * * * *